US005667951A

United States Patent [19]

Takizawa et al.

[11] Patent Number: 5,667,951

[45] Date of Patent: Sep. 16, 1997

[54] SILVER HALIDE COLOR PHOTOGRAPHIC MATERIAL CONTAINING PHOTOGRAPHIC YELLOW DYE-FORMING COUPLER

[75] Inventors: Hiroo Takizawa; Takeshi Nakamine; Yasuhiro Yoshioka; Masakazu Morigaki, all of Kanagawa, Japan

[73] Assignee: Fuji Photo Film Co., Ltd., Ashigara, Japan

[21] Appl. No.: 611,214

[22] Filed: Mar. 5, 1996

[30] Foreign Application Priority Data

Mar. 8, 1995 [JP] Japan ..... 7-074658

[51] Int. Cl.[6] ..... G03C 7/36; G03C 7/392; G03C 7/396

[52] U.S. Cl. ..... 430/551; 430/546; 430/557

[58] Field of Search ..... 430/556, 557, 430/551, 546

[56] References Cited

U.S. PATENT DOCUMENTS

| | | | |
|---|---|---|---|
| 4,026,709 | 5/1977 | Piller et al. | 430/552 |
| 4,745,049 | 5/1988 | Ohbayashi et al. | 430/556 |
| 4,935,321 | 6/1990 | Merkel | 430/546 |
| 5,021,333 | 6/1991 | Leyshon et al. | 430/557 |
| 5,028,519 | 7/1991 | Morigaki et al. | 430/551 |
| 5,188,926 | 2/1993 | Schofield et al. | 430/546 |
| 5,426,022 | 6/1995 | Hagemann | 430/556 |

FOREIGN PATENT DOCUMENTS

| | | |
|---|---|---|
| 570006 | 11/1993 | European Pat. Off. . |
| 52-20023 | 2/1977 | Japan . |

*Primary Examiner*—Lee C. Wright

*Attorney, Agent, or Firm*—Burns, Doane, Swecker & Mathis, LLP

[57] ABSTRACT

A silver halide color photographic material is disclosed which comprises a support having provided thereon at least one photographic layer containing: (i) at least one yellow dye-forming coupler represented by formula (I); and (ii) a compound represented by formula (IV), or an oligomer or polymer comprising a moiety of the compound represented by formula (IV):

(I)

wherein $R_1$ and $R_2$ each independently represents an aliphatic oxy group, an aliphatic group, an aryloxy group, an aryl group, an aliphatic amino group, or an anilino group; $R_3$ represents a hydrogen atom, an aliphatic group, or an aryl group; and Q represents a dye-forming coupler residue capable of forming a yellow dye by undergoing a coupling reaction with an oxidation product of a developing agent;

$$R_{31}CON(R_{32})R_{33} \quad \text{(IV)}$$

wherein $R_{31}$, $R_{32}$, and $R_{33}$ each independently represents a hydrogen atom, an aliphatic group, or an aryl group; provided that the sum of the carbon atom numbers of $R_{31}$, $R_{32}$ and $R_{33}$ is from 9 to 80, or $R_{31}$ and $R_{32}$, or $R_{32}$ and $R_{33}$ may combine with each other to form a ring.

7 Claims, No Drawings

SILVER HALIDE COLOR PHOTOGRAPHIC MATERIAL CONTAINING PHOTOGRAPHIC YELLOW DYE-FORMING COUPLER

FIELD OF THE INVENTION

The present invention relates to a silver halide color photographic material containing a novel photographic yellow dye-forming coupler.

BACKGROUND OF THE INVENTION

In a silver halide color photographic material, color images are formed by reacting dye-forming couplers (hereinafter, are referred to as couplers) and an aromatic primary amine developing agent which is oxidized by color developing after light-exposing the color photographic material. In general, in the color image forming process, a color reproducing process by a subtractive color process is used and for reproducing blue, green, and red, color images of yellow, magenta, and cyan which are in the complementary color relations of blue, green, and red, respectively are formed.

For forming yellow color images, an acylacetamide coupler or a malondianilide coupler is generally used as a yellow dye-forming coupler (hereinafter, is referred to as a yellow coupler); for forming magenta color images, a 5-pyrazolone coupler or a pyrazolotriazole coupler is generally used as a magenta coupler; and for forming cyan color images, a phenol coupler or a naphthol coupler is generally used as a cyan coupler.

The yellow dye, the magenta dye, and the cyan dye obtained from these couplers are generally formed in silver halide emulsion layers or layers adjacent thereto each having a color sensitivity to the radiation rays which are in a complementary color relation to the radiation rays absorbed by the dye.

Now, as a yellow coupler, in particular, a yellow coupler for image formation, an acylacetamide coupler such as a benzoylacetanilide coupler and a pivaloylacetanilide coupler is generally used. Since the benzoylacetanilide coupler generally has a coupling activity with the oxidized product of an aromatic primary amine developing agent at developing and also forms a yellow dye having a large molecule extinction coefficient, the coupler is mainly used for color photographic materials for photographing, which require a high sensitivity, in particular, for color negative films, and since acylacetamide coupler is excellent in the spectral absorption characteristics and the fastness of the yellow dye formed, the coupler is mainly used for color papers and color reversal films.

In addition, JP-A-52-20023 (the term "JP-A" as used herein means an "unexamined published Japanese patent application"), European Patent 570,006A, U.S. Pat. No. 4,026,709, etc., disclose yellow couplers having specific structures but these yellow couplers are yet insufficient in the coloring property, the fastness to light, heat, and humidity, the aging stability of emulsion under refrigeration (hereinafter sometimes referred to as cold storage stability of emulsion with the passage of time), etc., for practical use.

Also, recently, it has been desired to provide silver halide color photographic materials at a low cost by using inexpensive couplers. However, couplers produced by using inexpensive raw materials have the faults that they are inferior in coloring property and the cold storage stability of the silver halide emulsions containing the couplers with the passage of time is inferior since the couplers have low solubility in high-boiling point organic solvents. In particular, there is a tendency that these couplers capable of satisfying the coloring property have a low solubility in high-boiling point organic solvents, and on the contrary the couplers capable of satisfying the solubility have low coloring property. Furthermore, the dyes obtained from these couplers are insufficient in the image fastness and thus the development of couplers capable of forming dyes having a high coloring property has been desired.

SUMMARY OF THE INVENTION

Accordingly, an object of the present invention is to provide a silver halide color photographic material containing a yellow dye-forming coupler excellent in the coloring property.

Also, another object of this invention is to provide a silver halide photographic material containing a yellow dye-forming coupler excellent in the solubility in organic solvents and in the cold storage stability of the silver halide emulsion with the passage of time.

Furthermore, still another object of this invention is to provide a silver halide color photographic material containing a yellow dye-forming coupler giving color images excellent in the fastness to light, heat, and temperature.

Moreover, yet another object of this invention is to provide a silver halide color photographic material containing a yellow dye-forming coupler which can be produced using inexpensive raw materials obtained from natural materials.

It has now been discovered that the objects described above can be effectively attained by the present invention as described hereinbelow.

That is, according to an aspect of the present invention, there is provided a silver halide color photographic material comprising a support having thereon at least one photographic layer containing (i) at least one yellow dye-forming coupler represented by following formula (I), and (ii) a compound represented by formula (IV) or an oligomer or polymer comprising a moiety of the compound represented by formula (IV):

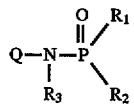

(I)

wherein $R_1$ and $R_2$ each independently represents an aliphatic oxy group, an aliphatic group, an aryloxy group, an aryl group, an aliphatic amino group, or an anilino group; $R_3$ represents a hydrogen atom, an aliphatic group, or an aryl group; and Q represents a dye-forming coupler residue capable of forming a yellow dye by undergoing a coupling reaction with an oxidation product of a color developing agent;

$$R_{31}CON(R_{32})R_{33} \quad \text{(IV)}$$

wherein $R_{31}$, $R_{32}$, and $R_{33}$ each independently represents a hydrogen atom, an aliphatic group, or an aryl group: provided that the sum of the carbon atom numbers of $R_{31}$, $R_{32}$, and $R_{33}$ is from 9 to 80; or $R_{31}$ and $R_{32}$, or $R_{32}$ and $R_{33}$ may combine with each other to form a ring.

It has further been discovered that the objects described above can be more effectively attained by the present invention described below.

That is, according to another aspect of the present invention, there is provided a silver halide color photographic material comprising a support having provided thereon at least one photographic layer containing a yellow dye-forming coupler represented by following formula (II)

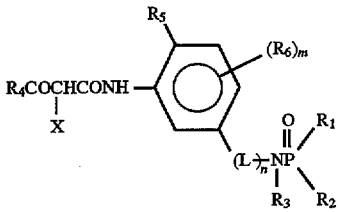

(II)

wherein $R_1$, $R_2$, and $R_3$ have the same meaning as $R_1$, $R_2$, and $R_3$ in the formula (I), respectively; $R_4$ represents an alkyl group, a cycloalkyl group, an aryl group, an alkylamino group, an anilino group, or a heterocyclic group; $R_5$ represents a hydrogen atom, a halogen atom, an aliphatic oxy group, an aryloxy group, an aliphatic group, or an amino group; $R_6$ represents a substituent; L represents a divalent linkage group; m represents an integer of from 0 to 3; n represents 0 or 1; and X represents a hydrogen atom or a group capable of being released by a coupling reaction with the oxidation product of an aromatic primary amino developing agent.

Furthermore, it has been discovered that when n is 0 in the formula (II) representing the yellow dye-forming coupler in the present invention described above, the objects of this invention can be particularly effectively attained.

DETAILED DESCRIPTION OF THE INVENTION

The present invention is explained in detail.

First, the yellow dye-forming coupler (hereinafter, is referred to as yellow coupler) of this invention represented by formula (I) is explained in detail.

In addition, the aliphatic moiety in the aliphatic group, the aliphatic oxy group, and the aliphatic amino group in the present specification, unless otherwise indicated, may be straight chain, branched chain, or cyclic; may contain an unsaturated bond; and may be substituted with a substituent known in yellow couplers. That is, the aliphatic group in the present specification includes alkyl, alkenyl, alkynyl, cycloalkyl, etc.

Also, the alkyl moiety in the alkyl group, the alkoxy group (alkyloxy group), and the alkylamino group in the present specification and the alkenyl group in the present specification, unless otherwise indicated, may be straight chain or branched chain and may be substituted with a substituent known in yellow couplers.

Furthermore, the cycloalkyl group in the present specification, unless otherwise indicated, may be substituted with a substituent known in yellow couplers and may form a condensed ring.

Still further, the aryl moiety in the aryl group and the aryloxy group in the present specification and the heterocyclic group in the present specification, unless otherwise indicated, may be substituted with a substituent known in yellow couplers and may form a condensed ring.

Also, the phenyl group and the N-position in and of the anilino group in the present specification, unless otherwise indicated, may be substituted with a substituent known in yellow couplers.

Furthermore, the amino group in the present specification, unless otherwise indicated, may be substituted with a substituent known in yellow couplers.

Also, when the compound of this invention represented by formula (I) includes geometric isomers such as unsaturated bonds, etc., the compound may be either isomer only or a mixture of the isomers.

Now, the details of the yellow coupler being used in the present invention are explained.

As the yellow coupler residue represented by Q in formula (I), there are, for example, a pivaloylacetanilide type coupler residue, a benzoylacetanilide type coupler residue, a malondiester type coupler residue, a malondiamide type coupler residue, a dibenzoylmethane type coupler residue, a benzothiazolylacetamide type coupler residue, a malonester monoamide type coupler residue, a triazolylacetamide type coupler residue, a benzoimidazolylacetamide type coupler residue, and a cycloalkanoylacetamide type coupler residue. Furthermore, the yellow coupler residue represented by Q may be the coupler residues described in U.S. Pat. Nos. 5,021,332 and 5,021,330 and European Patent 421,221A.

In formula (I), $R_1$ and $R_2$ each independently represents an aliphatic oxy group (preferably having from 1 to 20 carbon atoms, such as, methoxy, i-propoxy, t-butoxy, cyclohexyloxy, 3-phenylpropoxy, 4-t-butylcyclohexyloxy, hexyloxy, octyloxy, 2-ethylhexyloxy, oleyloxy, allyloxy, dodecyloxy, 3,5,5-trimethylhexyloxy, i-tridecyloxy, and 2-hexyldecyloxy), an aliphatic group (preferably having from 1 to 20 carbon atoms, such as methyl, i-propyl, t-butyl, hexyl, octyl, 2-ethylhexyl, benzyl, cyclohexyl, and allyl), an aryloxy group (preferably having from 6 to 26 carbon atoms, such as phenoxy, 3-methylphenoxy, 4-methoxyphenoxy, 2-chlorophenoxy, and 2-naphthoxy), an aryl group (preferably having from 6 to 26 carbon atoms, such as phenyl, 3-methylphenyl, 4-methoxyphenyl, 2-chlorophenyl, and 2-naphthyl), an aliphatic amino group (having preferably from 1 to 20 carbon atoms, such as N-octylamino, N,N-dibutylamino, 1-piperidino, and 1-morpholino), or an anilino group (preferably having from 6 to 26 carbon atoms, such as anilino, N-methylanilino, and N-phenylanilino); preferably represents an aliphatic oxy group, an aliphatic group, an aryloxy group, or an aryl group; and more preferably represents an aliphatic oxy group or an aryloxy group; and particularly preferably represents an aliphatic oxy group.

In addition, $R_1$ and $R_2$ may be the same or different but are preferably the same.

In formula (I), $R_3$ represents a hydrogen atom, an aliphatic group, (the preferred examples thereof are the same as those represented by $R_1$), or an aryl group (the preferred examples thereof are same as those represented by $R_1$); preferably represents a hydrogen atom or an aliphatic group, and more preferably represents a hydrogen atom.

In formula (I), it is preferred that $R_1$ and $R_2$ are the same, and represent an aliphatic oxy group or an aryloxy group, and in this case, the combination with that $R_3$ in formula (I) is a hydrogen atom is more preferred.

Then, the yellow dye-forming coupler represented by formula (II) are described in detail.

In formula (II), $R_1$, $R_2$, and $R_3$ have the same meaning as $R_1$, $R_2$, and $R_3$, respectively, in formula (I) described above.

In formula (II), $R_4$ represents an alkyl group having from 1 to 30 carbon atoms (e.g., methyl, ethyl, i-propyl, t-butyl, t-pentyl, octyl, and benzyl), a cycloalkyl group having from 3 to 30 carbon atoms (e.g., cyclopropyl, 1-methylcyclopropyl, 1-ethylcyclopropyl, 1-benzylcyclopropyl, cyclopentyl, 1-methylcyclohexyl, and cyclohexyl), an aryl group having from 6 to 36 carbon atoms (e.g., phenyl, 2-naphthyl, 4-methylphenyl, 4-methoxyphenyl, 3-acetylaminophenyl, and 2-chlorophenyl), a heterocyclic group having from 1 to 30 carbon atoms (e.g., indolin-1-yl, 3,5-dioxan-1-yl, and 1-methyl-3,5-dioxan-1-yl), an alkylamino group having from 1 to 30 carbon atoms (e.g., N-methylamino and N,N-dimethylamino), or an anilino group having from 6 to 36 carbon atoms (e.g., anilino and N-methylanilino); preferably represents an alkyl group, a cycloalkyl group, an aryl group, or a heterocyclic group; more preferably represents t-butyl, 1-methylcyclopropyl, 1-ethylcyclopropyl, 1-benzylcyclopropyl, 4-methoxyphenyl, or indolin-1-yl; particularly preferably represents t-butyl, 1-ethylcyclopropyl, or 4-methoxyphenyl; and most preferably represents t-butyl.

In formula (II), $R_5$ preferably represents a hydrogen atom, a halogen atom (e.g., fluorine, chlorine, bromine, and iodine), an aliphatic oxy group having from 1 to 30 carbon atoms (e.g., methoxy, i-propoxy, t-butoxy, benzyloxy, and cyclohexyloxy), an aryloxy group having from 6 to 36 carbon atoms (e.g., phenoxy, 2,4-di-t-butylphenoxy, 2-naphthoxy, 4-methoxyphenoxy, and 2-chlorophenoxy), an aliphatic group having from 1 to 30 carbon atoms (e.g., methyl, i-propyl, t-butyl, benzyl, trifluoromethyl, and cyclohexyl), or an amino group having from 0 to 30 carbon atoms (e.g., N,N-dimethylamino, N-cyclohexylamino, and N-butylamino); more preferably represents a halogen atom, an aliphatic oxy group, or an aryloxy group; furthermore preferably represents a chlorine atom or an aliphatic oxy group; particularly preferably represents a chlorine atom or a methoxy group; and most preferably represents a chlorine atom.

In formula (II), $R_6$ represents a substituent such as, preferably, an aliphatic group having from 1 to 30 carbon atoms (e.g., methyl, i-propyl, and t-butyl), an aliphatic oxy group having from 1 to 30 carbon atoms (e.g., methoxy, i-propoxy, benzyloxy, 2-ethylhexyloxy, hexadecyloxy, and cyclohexyloxy), an acylamino group having from 2 to 30 carbon atoms (e.g., acetylamino, benzylamino, and pivaloylamino), a carbamoyl group having from 1 to 30 carbon atoms (e.g., N-methylcarbamoyl, N-phenylcarbamoyl, N,N-dibutylcarbamoyl, and N-methyl-N-phenylcarbamoyl), an alkoxycarbonyl group having from 2 to 30 carbon atoms (e.g., methoxycarbonyl, hexyloxycarbonyl, and octadecyloxycarbonyl), an alkylsulfonamido group having from 1 to 30 carbon atoms (e.g., methanesulfonamido, octanesulfonamido, and hexadecanesulfonamido), an arylsulfonamido group having from 6 to 36 carbon atoms (e.g., benzenesulfonamido and p-chlorobenzenesulfonamido), a cyano group, a nitro group, and a halogen atom (e.g., chlorine and bromine); and more preferably represents an aliphatic group, an aliphatic oxy group, or a halogen atom.

In formula (II), L represents a divalent linkage group, and preferably represents —$N(R_{21})CO$—A—, —$N(R_{21})SO_2$—A—, —$CON(R_{21})$—A—, —$SO_2N(R_{21})$—A— or —COO—A—, wherein A represents an alkylene group having from 1 to 20 carbon atoms (e.g., methylene, ethylene, and —$CH(CH_3)CH_2$—) or a phenylene group having from 6 to 20 carbon atoms (e.g., —$C_6H_4$— and —$C_{10}H_6$—), and preferably represents an alkylene group; and $R_{21}$ represents a hydrogen atom, an aliphatic group (the preferred examples are same as those of Rdescribed above), or an aryl group (the preferred examples are same as those of $R_1$ described above), and preferably represents a hydrogen atom.

Also, L is preferably —NHCO—A— or —COO—A—, and particularly preferably —NHCO—A—.

In formula (II), m represents an integer of from 0 to 3, preferably represent 0 or 1, and most preferably represents 0.

In formula (II), n represents 0 or 1, and preferably represents 0.

In formula (II), X represents a hydrogen atom or a group capable of releasing by the coupling reaction with the oxidation product of an aromatic primary amine developing agent, and preferably represents a heterocyclic group or aryloxy group bonded to the coupling active position with a nitrogen atom.

When X represents a heterocyclic group, the heterocyclic group may be substituted and is a from 5- to 7-membered monocyclic group or a condensed heterocyclic group. Examples thereof are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidin-2-one, oxazolidin-2-one, thiazolidin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidin-4-one. These heterocyclic groups may be substituted. Examples of the substituent of the heterocyclic group are a halogen atom, a hydroxy group, a nitro group, a cyano group, a carboxyl group, a sulfo group, an alkyl group, an aryl group, an alkoxy group, an aryloxy group, an alkylthio group, an arylthio group, an alkyl-sulfonyl group, an aryl-sulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylmino group.

When X represents an aryloxy group, X preferably represents an aryloxy group having from 6 to 30 carbon atoms and the aryloxy group may be substituted with the substituent selected from the substituent group described above when X represents a heterocyclic group. Preferred examples of the substituent of the aryloxy group are a halogen atom, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, and a cyano group.

Now, in formula (II), X is preferably represented by one of following formulae (III-1) to (III-4);

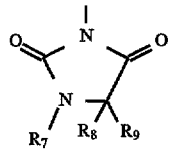

(III-1)

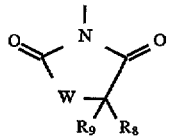

(III-2)

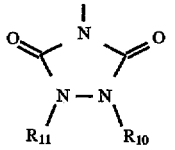

(III-3)

-continued (III-4)

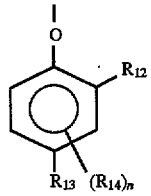

wherein $R_8$ and $R_9$ each independently represents preferably a hydrogen atom, an alkyl group having from 1 to 20 carbon atoms (e.g., methyl, ethyl, i-propyl, t-butyl, and benzyl), an aryl group having from 6 to 26 carbon atoms (e.g., phenyl, 2-naphthyl, 4-methoxyphenyl, 3-chlorophenyl, and 2-methylphenyl), an alkoxy group having from 1 to 20 carbon atoms (e.g., methoxy, ethoxy, i-propyloxy, and t-butoxy), an aryloxy group having from 6 to 26 carbon atoms (e.g., phenoxy), or a hydroxyl group, more preferably represents a hydrogen atom, an alkyl group having from 1 to 10 carbon atoms, or an alkoxy group having from 1 to 10 carbon atoms, and far more preferably represents a hydrogen atom, a methyl group, a methoxy group, or an ethoxy group.

Also, in the above formulae, $R_7$, $R_{10}$, and $R_{11}$ each independently represents preferably a hydrogen atom, an alkyl group having from 1 to 20 carbon atoms (the preferred examples thereof are the same as those of $R_8$), an aryl group having from 6 to 20 carbon atoms (the preferred examples thereof are the same as those of $R_8$ described above), an aralkyl group having from 7 to 20 carbon atoms (e.g., benzyl and phenetyl), or an acyl group having from 1 to 20 carbon atoms (e.g., acetyl and benzoyl), more preferably represents a hydrogen atom, an alkyl group, or an aralkyl group, and far more preferably represents a hydrogen atom, a methyl group, an ethyl group, or a benzyl group.

In formula (III-2) described above, W represents am oxygen atom or a sulfur atom, and is preferably an oxygen atom.

In formula (III-4), at least one of $R_{12}$ and $R_{13}$ is a halogen atom, a cyano group, a nitro group, a trifluoromethyl group, a carboxyl group, an alkoxycarbonyl group having from 2 to 20 carbon atoms (e.g., methoxycarbonyl and i-propyloxycarbonyl), an acylamino group having from 2 to 20 carbon atoms (e.g., acetylamino and benzoylamino), a sulfonamido group having from 1 to 20 carbon atoms (e.g., methanesulfonamido and 4-methylphenylsulfonamido), a carbamoyl group having from 1 to 20 carbon atoms (e.g., N,N-diethylcarbamoyl and N-butylcarbamoyl), a sulfamoyl group having from 0 to 20 carbon atoms (e.g., N,N-dimethylsulfamoyl and N-phenylsulfamoyl), an alkylsulfonyl group having from 1 to 20 carbon atoms (e.g., methylsulfonyl and i-propylsulfonyl), an arylsulfonyl group having from 6 to 26 carbon atoms (e.g., phenylsulfonyl, 4-benzyloxyphenylsulfonyl, and 4-hydroxyphenylsulfonyl), an acyl group having from 2 to 20 carbon atoms (e.g., acetyl and benzoyl), or a hydroxyl group and another one of $R_{12}$ and $R_{13}$ is the foregoing substituent or a hydrogen atom, an alkyl group, or an alkoxy group.

In formula (III-4), $R_{14}$ has the same meaning as $R_{12}$ or $R_{13}$ and n represents an integer of from 0 to 2.

In formula (III-1), it is preferred that $R_7$ is a hydrogen atom, an alkyl group having from 1 to 4 carbon atoms, or a benzyl group and $R_8$ and $R_9$ each is a hydrogen atom, an alkyl group having from 1 to 4 carbon atoms, or an alkoxy group having from 1 to 4 carbon atoms; it is more preferred that $R_7$, $R_8$, and $R_9$ each is a hydrogen atom or an alkyl group having from 1 to 4 carbon atoms; it is furthermore preferred that $R_7$ is a hydrogen atom and $R_8$ and $R_9$ each is a methyl group or that $R_7$ is a methyl group and $R_8$ and $R_9$ each is a hydrogen atom, and it is most preferred that $R_7$ is a hydrogen atom and $R_8$ and $R_9$ each is a methyl group.

In formula (III-2), it is preferred that W is an oxygen atom and $R_8$ and $R_9$ is a methyl group.

In formula (II) described above, X is preferably represented by formula (III-1) or (III-2), and is more preferably represented by formula (III-1).

Then, specific examples of X in formula (II) are shown below but the invention is not limited to these groups.

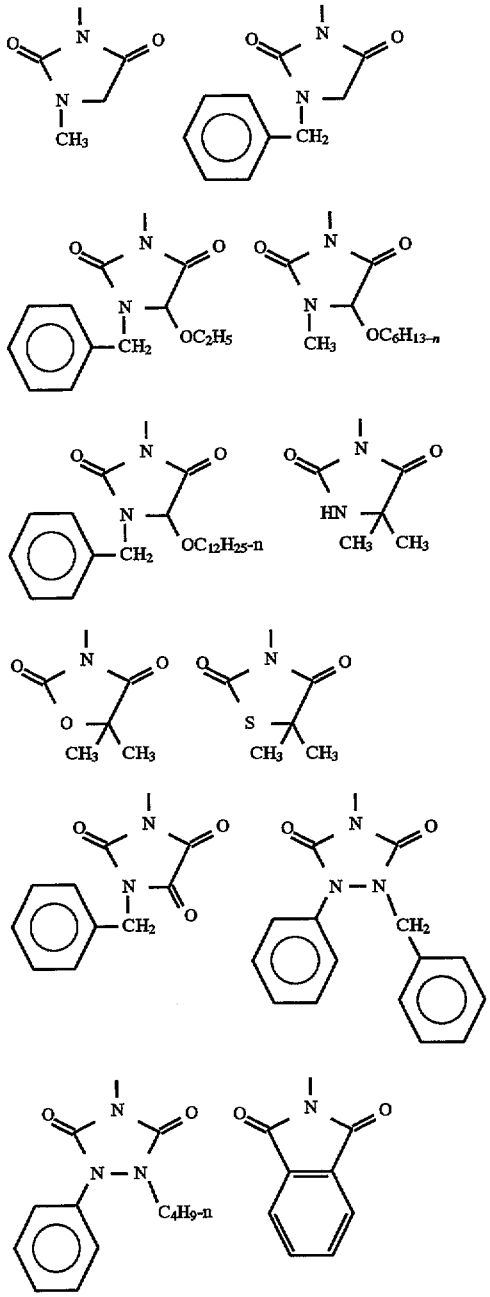

-continued
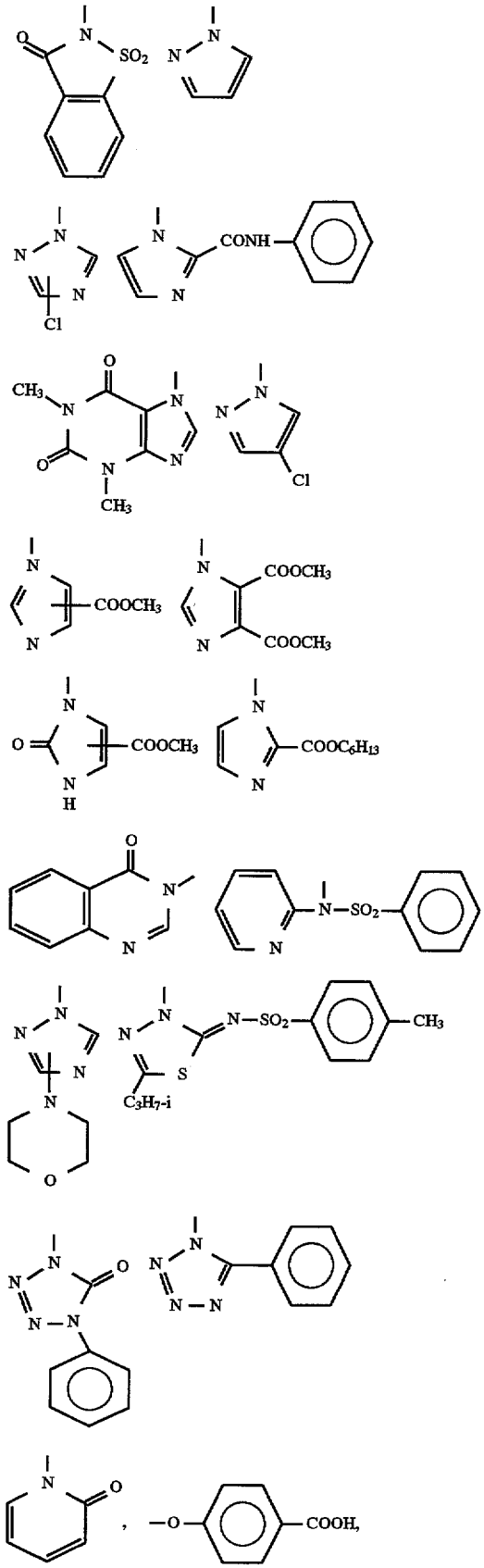
-continued
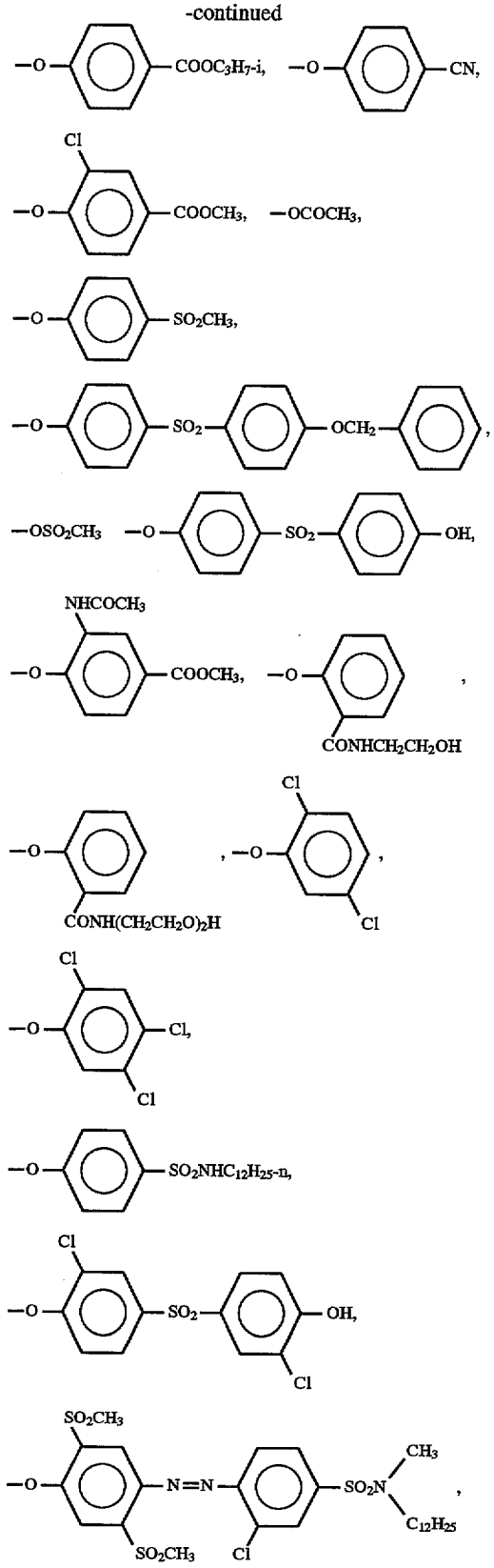
In addition, the yellow coupler represented by formula (II) described above may form a dimer or a polymer at $R_1$, $R_3$, $R_4$, $R_5$, X, etc., of them via a group of divalent or more. In this case, the carbon atom numbers may become outside the carbon atom number range shown above in each substituent.

A preferred combination of the yellow coupler represented by formula (II) is that X is the group represented by formula (III-1); $R_5$ is a chlorine atom or a methoxy group; m is 0; n is 0; $R_1$ and $R_2$ are the same, and represents an aliphatic oxy group or an aryloxy group; and $R_3$ is a hydrogen atom; and it is more preferred that in this case, $R_4$ is a t-butyl group, a 4-methoxyphenyl group, a 1-ethylcyclopropyl group, or a 1-indolinyl group. In this case, it is more preferred that $R_7$, $R_8$, and $R_9$ each independently is a hydrogen atom or a methyl group and $R_1$ and $R_2$ are the same aliphatic oxy group; it is furthermore preferred that $R_4$ is a t-butyl group; and it is most preferred that $R_5$ is a chlorine atom.

Then, specific examples of the yellow coupler represented by formula (I) being used in the present invention are illustrated below but the yellow couplers being used in this invention are not limited to these couplers.

Y-1

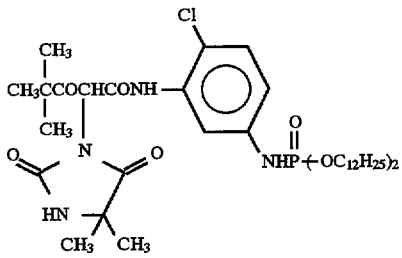

Y-2

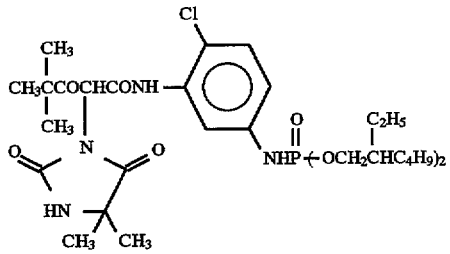

Y-3

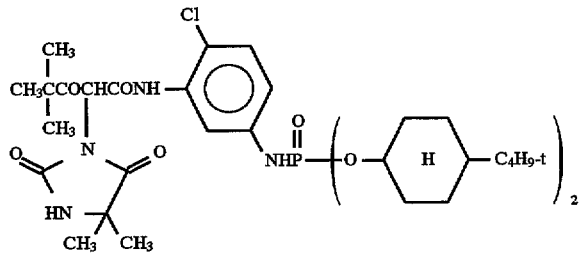

Y-4

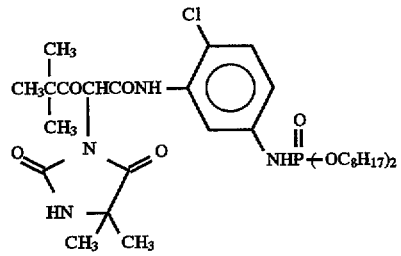

Y-5

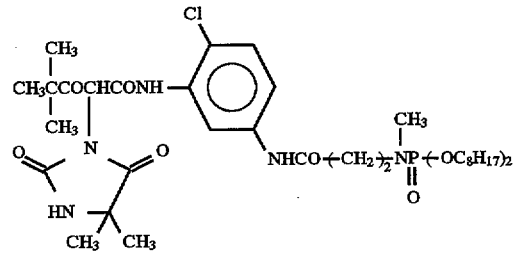

-continued
Y-6
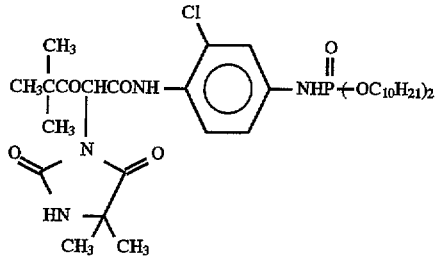
Y-7
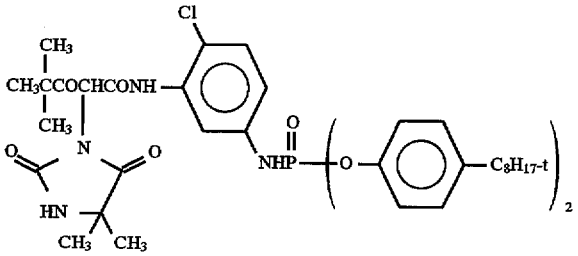
Y-8
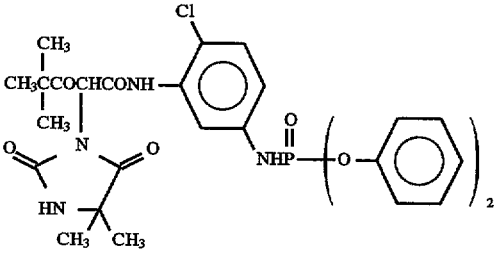
Y-9
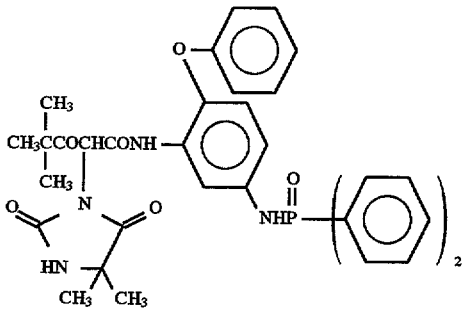
Y-10
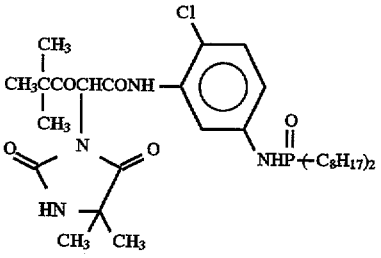
Y-11
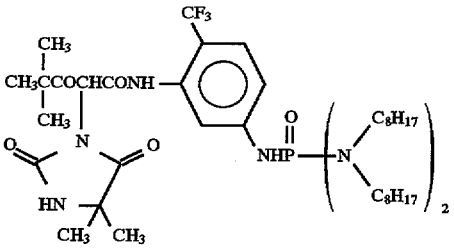

-continued
Y-12
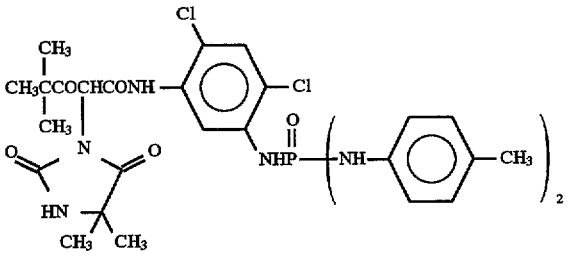
Y-13
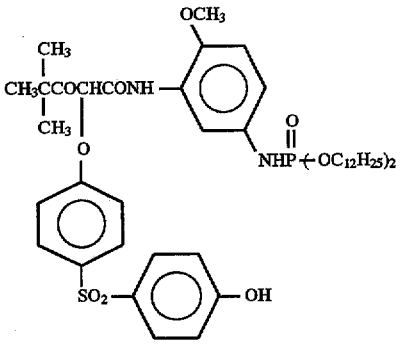
Y-14
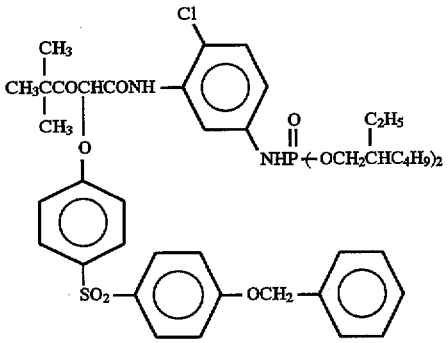
Y-15
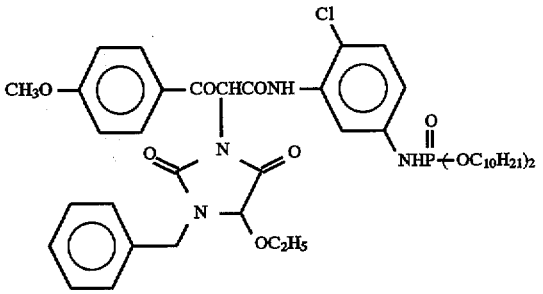
Y-16
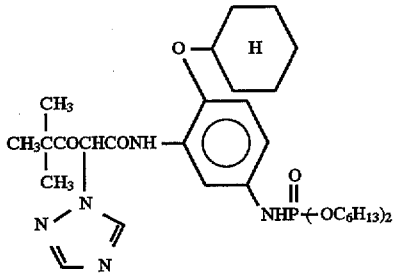

-continued
Y-17
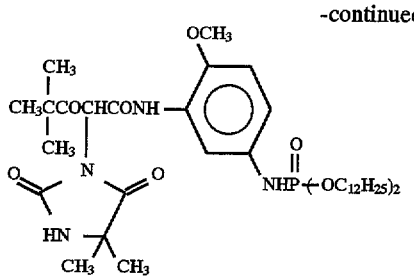
Y-18
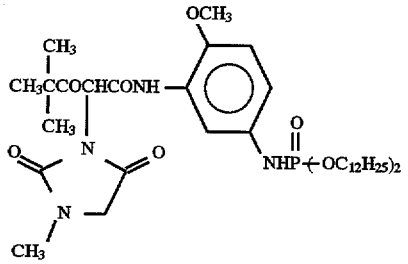
Y-19
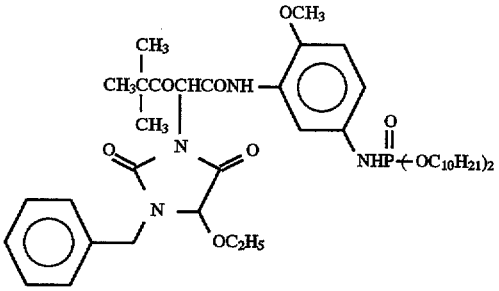
Y-20
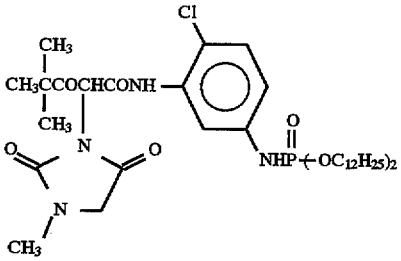
Y-21
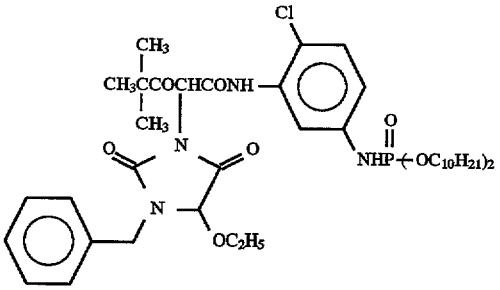
Y-22
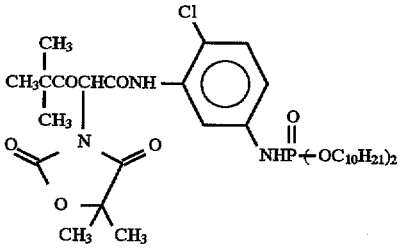

-continued
Y-23
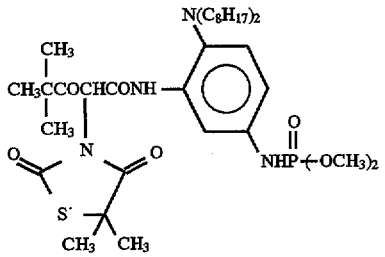
Y-24
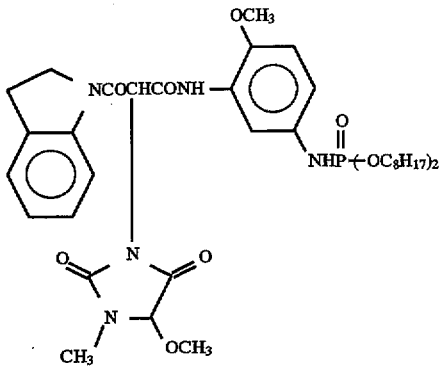
Y-25
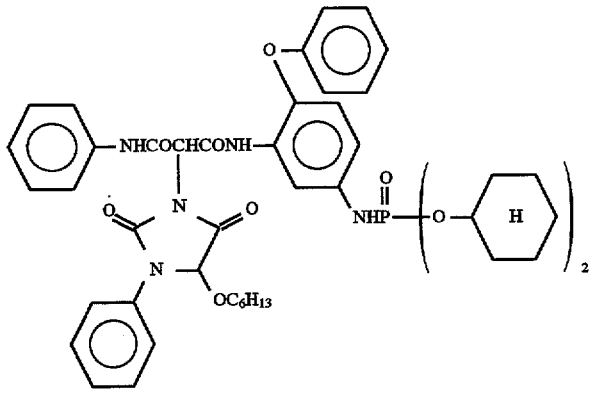
Y-26
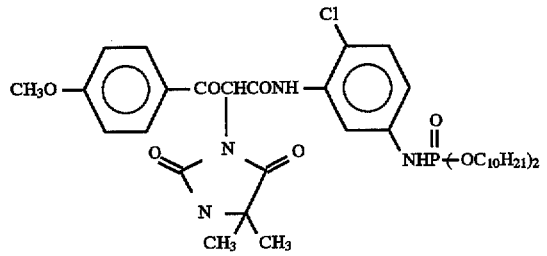
Y-27
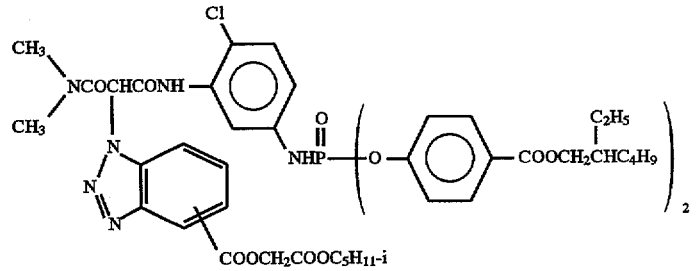

-continued
Y-28
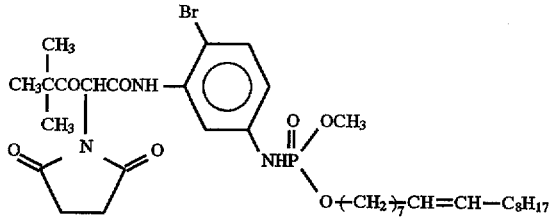
Y-29
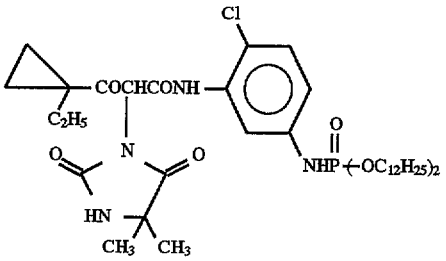
Y-30
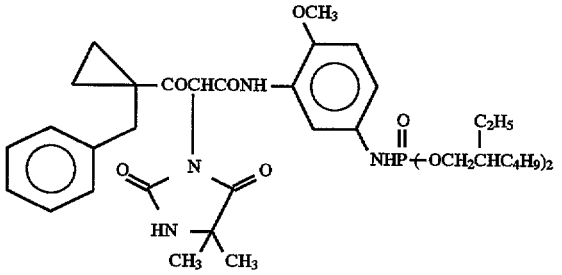
Y-31
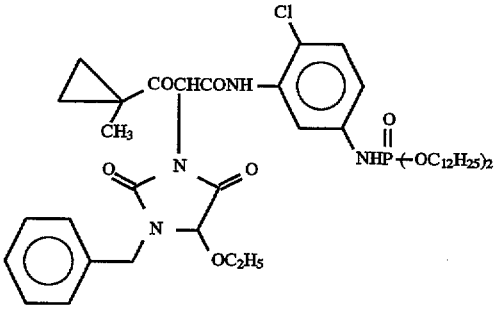
Y-32
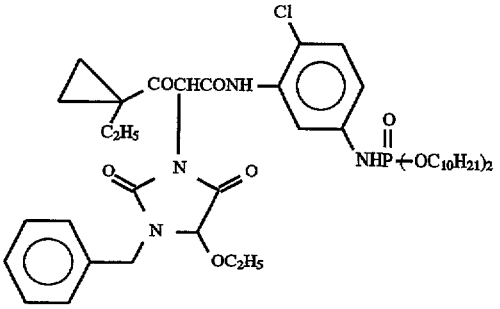

-continued
Y-33
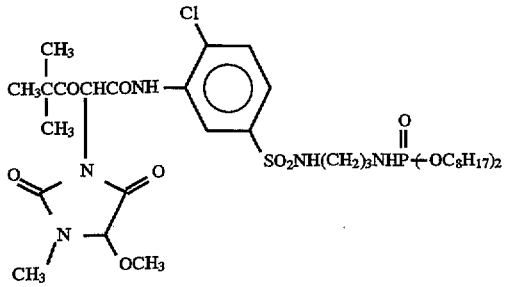
Y-34
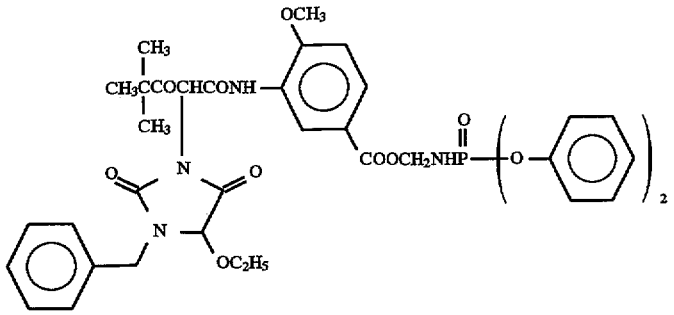
Y-35
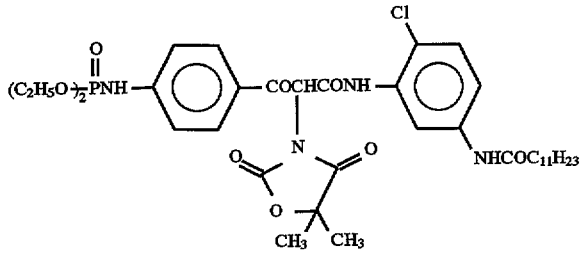
Y-36
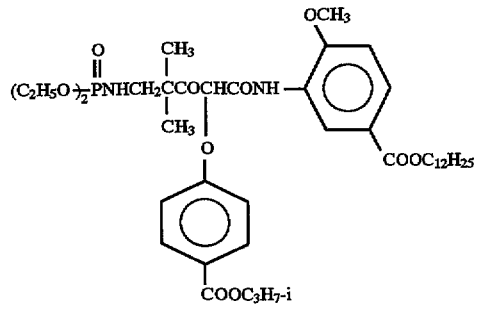
Y-37
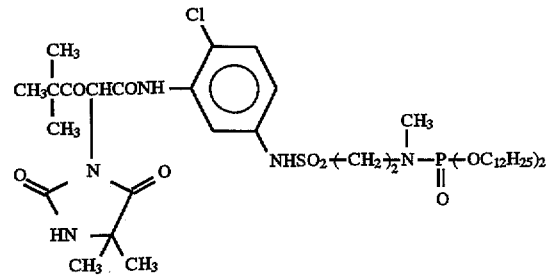

-continued
Y-38
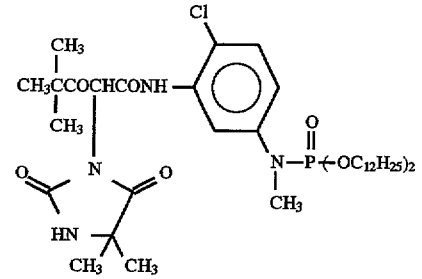
Y-39
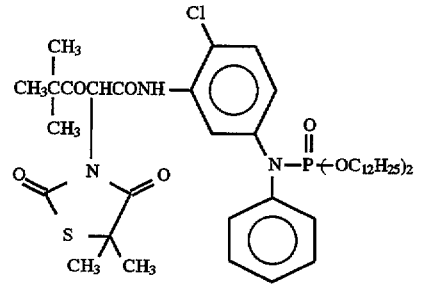
Y-40
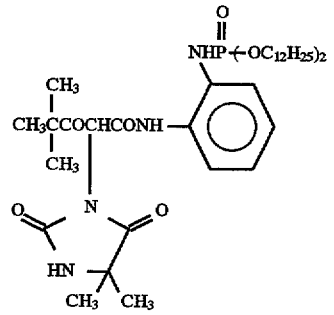
Y-41
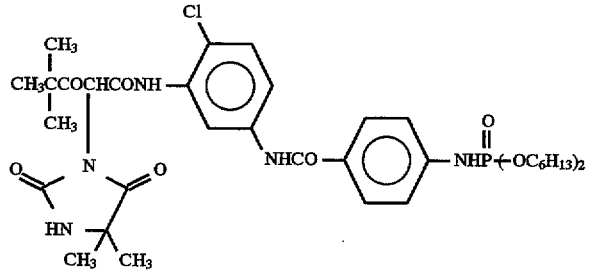
Y-42
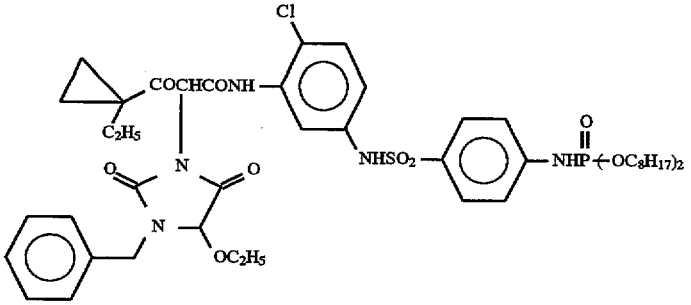

-continued
Y-43
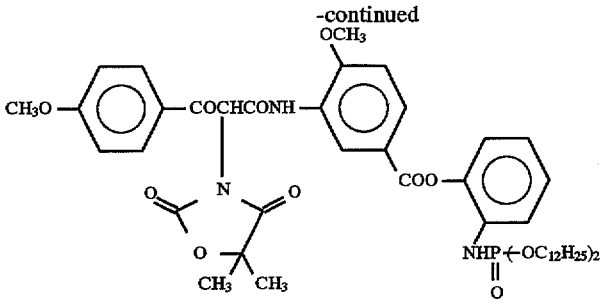
Y-44
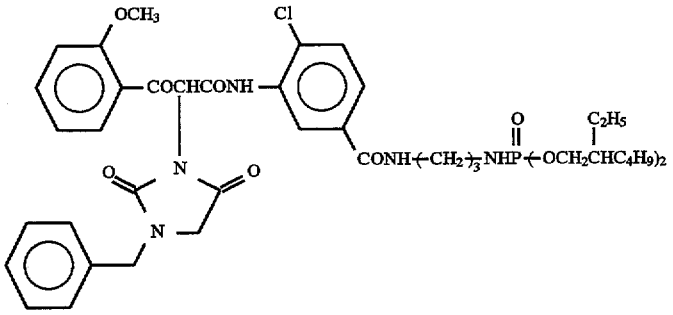
Y-45
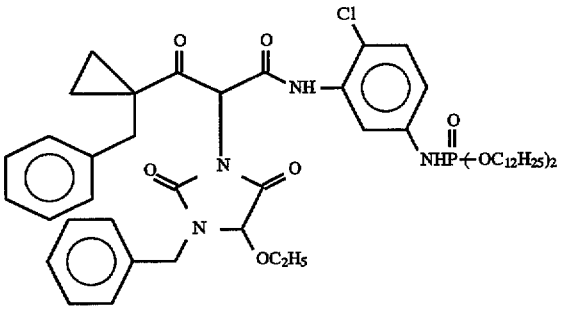
Y-46
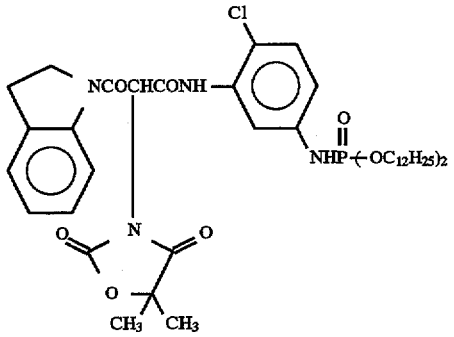
Y-47
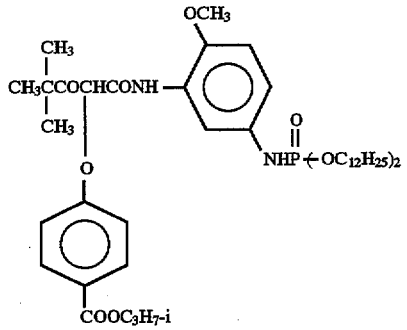
The yellow coupler represented by formula (I) being used in the present invention can be generally produced by the step of subjecting phosphoric acid chloride synthesized by reacting phosphorus oxychloride and an alcohol, a phenol, an amine, etc., and an amine containing a coupler mother nucleus (that is, Q—$NH_2$ in formula (I)) to an amidation reaction in a solvent such as dimethyl acetamide, acetonitrile, toluene, ethyl acetate, etc., in the presence of a deoxidizer such as triethylamine, pyridine, potassium carbonate, etc.

Then, a synthesis example of the yellow coupler represented by formula (I) being used in the present invention is shown below by the invention is not limited to it.

Synthesis of Coupler Y-1:

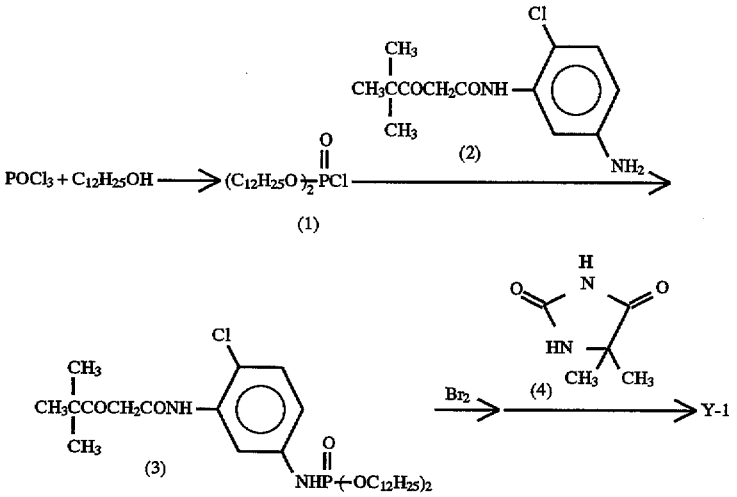

In 200 ml of hexane was dissolved 76.7 g (0.5 mol) of phosphorus oxychloride and after cooling the solution to an inside temperature of 5° C., the solution was stirred. Then, a solution obtained by dissolving 186.3 g (1.0 mol) of dodecanol and 151.8 g (1.5 mol) of triethylamine in 250 ml of hexane was added dropwise to the solution over a period of 2 hours while taking care not to increase the inside temperature over 10° C. followed by further stirring at room temperature for 3 hours.

Then, after filtering off triethylamine hydrochloride, the reaction mixture was concentrated under reduced pressure to provide phosphorus chloride (1).

To phosphorus chloride (1) obtained were added 120.9 g (0.45 mol) of aniline (2) and 200 ml of dimethylacetamide, and the mixture was stirred for 5 hours at 80° C.

Then, ethyl acetate and water were added to the mixture and the organic phase thus formed was separated and washed twice with water. Then, after drying the organic phase with anhydrous magnesium sulfate, the organic phase was concentrated and the residue was subjected to silica gel column chromatography (developing solvent: ethyl acetate/hexane=1/5) to isolate and purify an amide compound (3).

The amount of the compound was 185.4 g (yield 60.1%).

Then, 68.5 g (0.1 mol) of the amide compound (3) obtained was dissolved in 200 ml of methylene chloride followed by stirring, 16.0 g (0.1 mol) of bromine was added dropwise to the solution over a period of 20 minutes and the mixture was further stirred for 30 minutes. After washing the mixture once with water, the mixture was added dropwise to a solution obtained by dissolving 25.6 g (0.2 mol) of a hydantoin compound (4) and 30.4 g (0.2 mol) of DBU followed by stirring over a period of 20 minutes.

After adding water to the mixture, an organic phase formed was separated, washed 3 times with water, and after drying with anhydrous magnesium sulfate, the organic phase was concentrated.

The resulting residue was purified by silica gel column chromatography (developing solvent: ethyl acetate/hexane=1/3 to 1/1) to provide amorphous compound Y-1.

The amount thereof was 67.4 g (yield 83.1%).

$^1$HNMR spectra (300 MHz, $CDCl_3$, δ: ppm) 0.88 (6H, t, $CH_3CH_2$—) 1.25 (36H, m, —$CH_2$—) 1.28 (9H, s, $(CH_3)_3C$—) 1.48 (3H, s, $(CH_3)C_2$<) 1.54 (3H, s, $(CH_3)_2C$<) 1.66 (4H, m, —$OCH_2CH_2$—) 3.9–4.15 (4H, m, —$OCH_2$—) 5.68 (1H, s, CH) 6.14 (1H, d, —P(O)NH—) 6.74 (1H, s, —CONH—) 6.80 (1H, d of d, aromatic) 7.19 (1H, d, aromatic) 7.92 (1H, d, aromatic) 9.34 (1H, s, —CONH—)

MS spectrum 810 ($M^+$)

As the yellow coupler being used in the present invention, the yellow couplers represented by formula (I) may be used singly or as a mixture thereof, or may be used as a combination with other known yellow coupler.

The photographic layer containing the yellow coupler represented by formula (I) being used in the present invention may be any hydrophilic colloid layer containing the compound represented by formula (I), and it is preferred to use the yellow coupler represented by formula (I) in a blue-sensitive silver halide emulsion layer.

The using amount of the yellow coupler represented by formula (I) in the silver halide color photographic material (hereinafter sometimes referred to as a photographic material) is in the range of preferably from 0.01 to 10 mmol/$m^2$, more preferably from 0.05 to 5 mmol/$m^2$, and most preferably from 0.1 to 2 mmol/$m^2$. As described above, the yellow couplers represented by formula (I) may be used as a mixture thereof, or together with other known yellow coupler.

The objects of the present invention described above are more remarkably attained by the silver halide color photographic material having on a support a layer containing the yellow coupler represented by formula (I) together with a compound represented by following formula (IV).

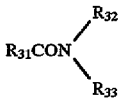

(IV)

Then, the compound represented by formula (IV) described above is explained in detail.

In formula (IV), $R_{31}$, $R_{32}$, and $R_{33}$ each independently represents preferably a hydrogen atom, an aliphatic group having from 1 to 40 carbon atoms (e.g., methyl, ethyl, t-butyl, i-propyl, benzyl, 1-(2,4-di-t-amylphenoxy)propyl, heptyl, undecyl, 1-ethylpentyl, cyclohexyl, 9-decenyl, 1-hexylnonyl, 2-ethylhexyl, dodecyl, 1-hexyldecyl, octyl, and 4,6,6-trimethyl-1-(1,3,3-trimethylbutyl)heptyl), or an aryl group having from 6 to 40 carbon atoms (e.g., phenyl, 2-naphthyl, 2-chlorophenyl, 3-methylphenyl, and 4-octyloxyphenyl), and the sum total of the carbon atom numbers of $R_{31}$, $R_{32}$, and $R_{33}$ is from 9 to 80, preferably from 13 to 60, and more preferably from 15 to 50. Also, $R_{31}$ and $R_{32}$, or $R_{32}$ and $R_{33}$ may combine with each other to form a ring (e.g., a piperidine ring, a piperazine ring, a morpholine ring, a pyrrolidine ring, and a triazine ring).

In addition, the compounds represented by formula (IV) may form an oligomer or a polymer by combining at any position of $R_{31}$, $R_{32}$, and $R_{33}$ and in this case, the carbon atom number range may exceed the range defined above.

The compound represented by formula (IV) for use in the present invention is preferably represented by following formula (V).

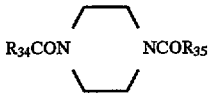

(V)

wherein $R_{34}$ and $R_{35}$ have the same meanings as $R_{31}$ in formula (IV) and the sum total of the carbon atom numbers of $R_{34}$ and $R_{35}$ is from 12 to 75.

In formula (V), it is preferred that $R_{34}$ and $R_{35}$ are the same substituent; and in this case, it is more preferred that both $R_{34}$ and $R_{35}$ are an alkyl group having from 8 to 26 carbon atoms; and it is furthermore preferred that both $R_{34}$ and $R_{35}$ are a branched alkyl group as shown in formula (VI) described below.

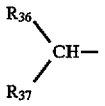

(VI)

wherein $R_{36}$ represents a straight chain or branched alkyl group having from 4 to 13 carbon atoms and $R_{37}$ represents a straight chain or branched alkyl group having from 2 to 11 carbon atoms.

In formula (VI), it is preferred that $R_{36}$ is a branched alkyl group having from 7 to 13 carbon atoms and $R_{37}$ is a branched alkyl group having from 5 to 11 carbon atoms; and it is more preferred that $R_{36}$ is a branched alkyl group having from 9 to 10 carbon atoms and $R_{37}$ is a branched alkyl group having from 7 to 8 carbon atoms. It is most preferred that the carbon atom number of $R_{37}$ is less than that of $R_{36}$ by 2.

Then, specific examples of the compound represented by formula (IV) for use in this invention are shown below but the invention is not limited to them. In addition, when there is a description as $C_8H_{17}$-i, the form of the branch may be a single form or a mixture of any components. For example, when $C_8H_{17}$-i is described, it may be a mixture of 2-ethylhexyl, 2-ethyl-4-methylpentyl, 2,2,4-trimethylpentyl, etc.

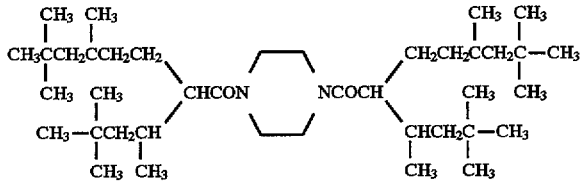

S-1

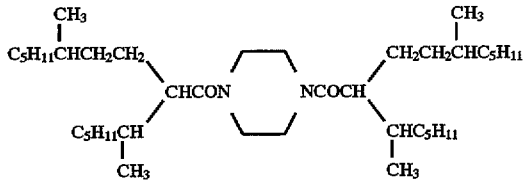

S-2

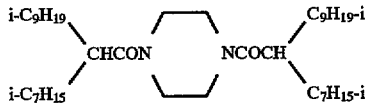

S-3

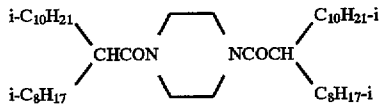

S-4

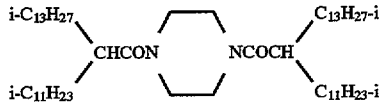

S-5

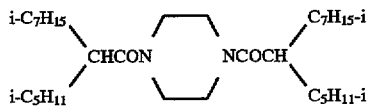

S-6

-continued
S-7
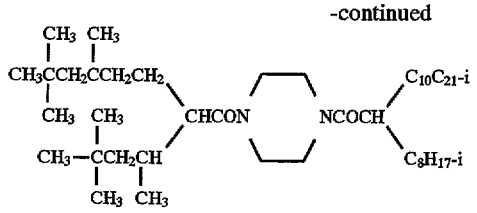
S-8
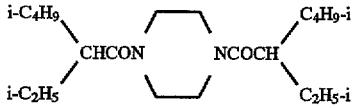
S-9
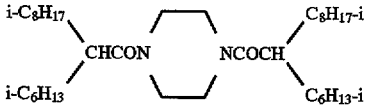
S-10
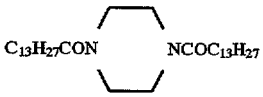
S-11
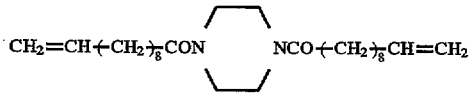
S-12
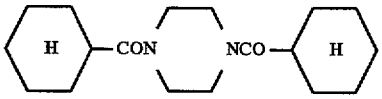
S-13
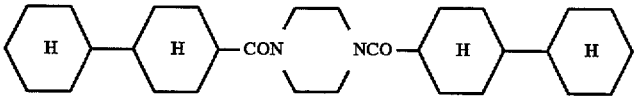
S-14
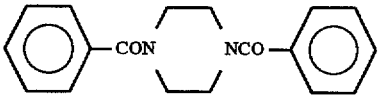
S-15
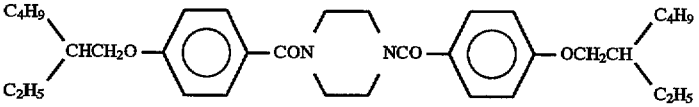
S-16
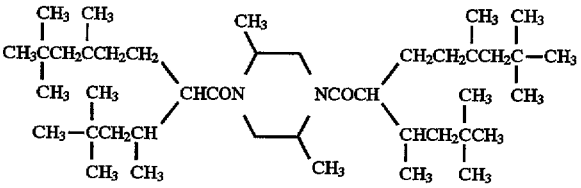
S-17
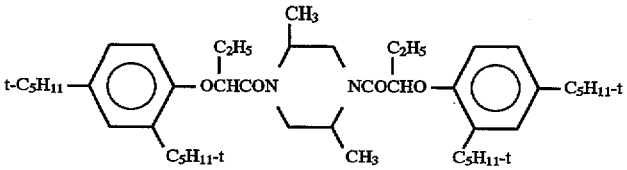
S-18
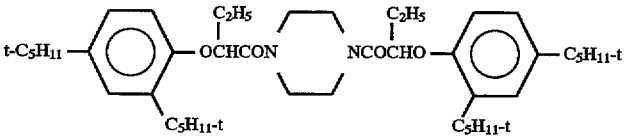

-continued
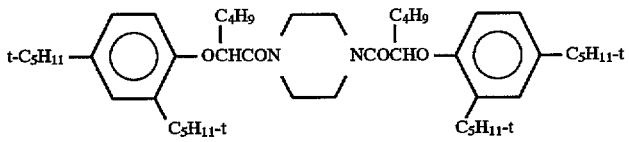
S-19
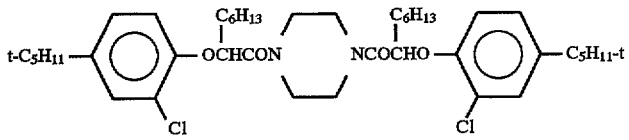
S-20
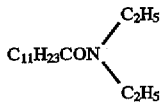
S-21
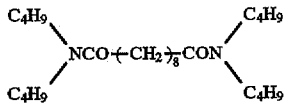
S-22
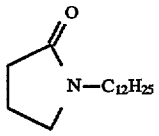
S-23
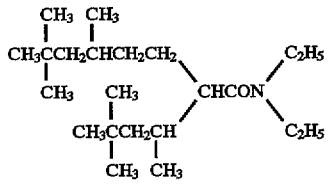
S-24
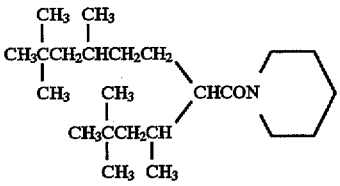
S-25
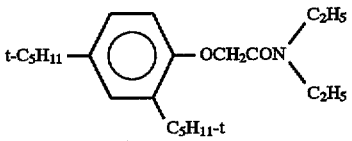
S-26
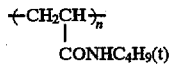
S-27
average molecular weight: 60,000
$C_8H_{17}CH{=}CH(CH_2)_7CONH_2$ S-28
$C_8H_{17}CH{=}CH(CH_2)_7CONH(CH_2)_8CH{=}CHC_8H_{17}$ S-29
i-$C_{17}H_{35}CONHCH_2CH_2NHCOC_{17}H_{35}$-i S-30

-continued

S-31

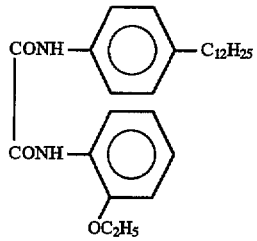

S-32

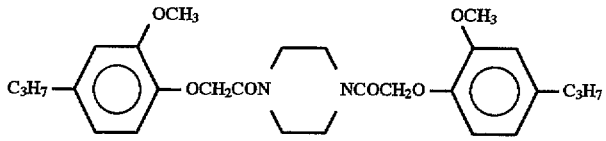

S-33

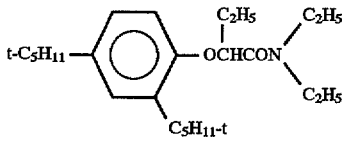

S-34

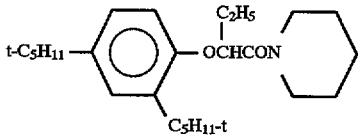

Then, a synthesis example of the compound shown in formula (IV) is shown below.

In addition, the compound represented by formula (IV) can be generally easily synthesized by converting a carboxylic acid to a carboxylic acid chloride using thionyl chloride, phosphorus trichloride, oxalyl chloride, etc., and thereafter reacting the carboxylic acid chloride and an amine using a deoxidizer such as triethylamine, sodium carbonate, or potassium carbonate.

Synthesis of Compound S-1:

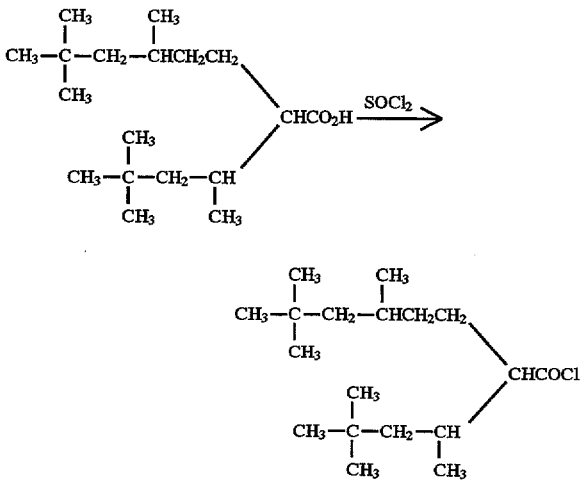

Nissan Chemical Industries, Ltd. (4)

"Fine Oxocole" isostearic acid

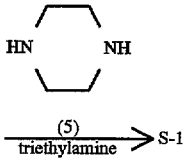

To 568.9 g (2 mol) of isostearic acid made by Nissan Chemical Industries, Ltd., was added 1.0 g of DMF, and 261.8 g (2.2 mol) of thionyl chloride was added dropwise to the mixture with stirring over a period of 30 minutes. After stirring the mixture for 30 minutes at room temperature, the mixture was further stirred for 30 minutes at 40° C. and concentrated under reduced pressure by an aspirator to provide 605.8 g (yield 100%) of carboxylic acid chloride (4).

In 1250 ml of ethyl acetate were dissolved 86.1 g (1 mol) of anhydrous piperazine (5) and 242.8 g (2.4 mol) of triethylamine and the solution was stirred under ice-cooling. To the solution was added dropwise 605.8 g of the carboxylic acid chloride described above over a period of one hour, and after further stirring the mixture for 30 minutes, the mixture was stirred for one hour at 50° C.

Then, 500 ml of water was added to the reaction mixture, an organic phase thus formed was extracted, washed 3 times with water and after drying with magnesium sulfate, was concentrated to provide 607.0 g (yield 98.1%) of light-yellow oily compound S-1.

The structure of the product was analyzed by the NMR spectra, the IR spectra, the MS spectra, and gas chromatography.

NMR Spectra (300 MHz, $CDCl_3$, δ: ppm) 1.0–1.2 (48H, s or d, $CH_3$) 1.2–2.0 (20H, m, —$CH_2$— or =CH—) 2.4–2.7 (2H, m, —CHCO<) 3.6–4.0 (8H, m, >$NCH_2CH_2N$<)

MS Spectra: 618($M^+$), 603, 551, 463, 353

In addition, the compound represented by formula (IV) may be used singly or together with other compound represented by formula (IV), or may be used as a combination with a known fading inhibitor.

The compound represented by formula (IV) mainly functions as a high-boiling point organic solvent but may be used together with a known high-boiling point organic solvent or may be used as an additive such as a stabilizer, etc. The term "high-boiling point" herein means that the organic solvent has a boiling point of 175° C. or higher at atmospheric pressure.

The using amount of the compound represented by formula (IV) can be changed according to the intended purposes and there is no particular restriction on the amount thereof. However, the using amount of the compound is preferably from 0.0002 g to 20 g, and more preferably from 0.001 g to 5 g per 1 $m^2$ of the silver halide color photographic material and also is, for example, in the range of preferably from 0.1 to 8, more preferably from 0.1 to 4.0, and furthermore preferably from 0.2 to 1.0 by weight ratio to the amount of the yellow coupler represented by formula (I).

When the compound represented by formula (IV) is used together with a known high-boiling point organic solvent, the compound of formula (IV) is used in an amount of preferably from 10% to 100%, and more preferably from 20% to 70% by weight to the total amount of the high-boiling point organic solvents.

Examples of such a high-boiling point organic solvent which can be used together with the compound represented by formula (IV) are described in U.S. Pat. No. 2,322,027, etc.

Specific examples of such a high-boiling point organic solvent having a boiling point of 175° C. or higher at atmospheric pressure are phthalic acid esters (e.g., dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate, and bis(1,1-diethylpropyl) phthalate); esters of phosphoric acid or phosphonic acid (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate); benzoic acid esters (e.g., 2-ethylhexyl benzoate, dodecyl benzoate, and 2-ethylhexyl-p-hydroxy benzoate); sulfonamides (e.g., N-butylbenzene sulfonamide); alcohols and phenols (e.g., isostearyl alcohol and 2,4-di-tert-amylphenol); aliphatic carboxylic acid esters [e.g., bis(2-ethylhexyl) sebacate, dioctyl azelate, glycerol tributyrate, isostearyl lactate, and trioctyl citrate); aniline derivatives (e.g., N,N-dibutyl-2-butoxy-5-tertoctylaniline); hydrocarbons (e.g., paraffin, dodecylbenzene, and diisopropylnaphthalene); and chlorinated paraffins.

Also, in the present invention, an organic solvent having a boiling point of 30° C. or more, preferably from 50° C. to about 160° C. can be used as an auxiliary solvent. Typical examples of such a solvent are ethyl acetate, butyl acetate, ethyl propionate, methyl ethyl ketone, cyclohexanone, 2-ethoxyethyl acetate, and dimethylformamide.

A general silver halide color photographic material can be constituted by successively coating at least one blue-sensitive silver halide emulsion layer, at least one green-sensitive silver halide emulsion layer, and at least one red-sensitive silver halide emulsion layer on a support in this order but other disposition order of the silver halide emulsion layers may be employed. By incorporating each silver halide emulsion having a sensitivity to each wavelength region and each color coupler forming a dye which is a complementary color relationship with each sensitive light in each of these light-sensitive emulsion layers, a color reproduction by a subtractive color process can be carried out. In this case, however, the light-sensitive emulsion layer and the colored hue of the color coupler may have a constitution which does not have the foregoing correspondence.

As the silver halide emulsions and other materials (additives, etc.), and photographic constituting layers (layer dispositions, etc.) which are applied to the present invention and the processing processes for processing the photographic materials of this invention, and additives for processing, the materials and processes described in JP-A-62-215272, JP-A-2-33144, and European Patent 355,660A2 are preferably used.

Furthermore, the silver halide color photographic materials and the processing processes therefor described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641, European Patent 520,457A2, etc., can be preferably used in this invention.

As the silver halide for use in the present invention, silver chloride, silver bromide, silver chlorobromide, silver iodochloro-bromide, silver iodobromide, etc., can be used. For the purpose of rapid processing, pure silver chloride or silver chlorobromide which does not substantially contain silver iodide and has a silver chloride content of from 90 mol % to 100 mol %, preferably from 95 mol % to 100 mol %, and particularly preferably from 98 mol % to 100 mol % is preferably used.

In the photographic material of this invention, for the purpose of improving the sharpness of images, etc., it is preferred to add the dye capable being decolored by processing (in particular, the oxonol series dye) described in European Patent 337,490A2, pages 27–76, etc., to the hydrophilic colloid layer thereof such that the optical reflection density of the photographic material at 680 nm becomes 0.70 or greater, or to add at least 12% by weight (preferably at least 14% by weight) of titanium oxide which is surface-treated with a dihydric to tetra-hydric alcohol (e.g., trimethylolethane) into the water-resisting resin layer of the resin-coated support thereof.

In the photographic material of the present invention, it is preferred to use the color image storage stability improving compound described in European Patent 277,589A2 together with the couplers. In particular, it is preferred to use the compound together with a pyrazoloazole series magenta coupler.

That is, it is preferred to use the compound (F) which forms a chemically inactive and substantially colorless compound by chemically bonding with an aromatic amino color developing agent remaining after color development and/or the compound (G) which forms a chemically inactive and substantially colorless compound by chemically bonding with the oxidation product of an aromatic amine color developing agent remaining after color development simultaneously or singly for preventing, for example, the generation of stains and other side-effects due to the formation of colored dyes by the reaction of a color developing agent or the oxidized product thereof with the couplers during storing the processed color photographs after processing.

In the photographic materials of the present invention, it is preferred to incorporate the antifungal agent as described in JP-A-63-271247 for preventing the growth of various kinds of fungi and bacteria growing in the hydrophilic colloid layers to deteriorate the color images.

As the support which is used for the photographic material of this invention, a white polyester series support for display or a support having provided thereon a layer containing a white pigment on the side having the silver halide emulsion layers may be used. Furthermore, for improving the sharpness of color images, it is preferred to form an antihalation layer on the silver halide emulsion layer coating side of the support or the back surface of the support. In particular, for capable of observing the display or color images by reflected light and transmitted light, it is preferred that the transmission density of the support is selected in the range of from 0.35 to 0.8.

The photographic material of the present invention may be exposed with visible light or infrared light. As the exposure method, a low-illuminance exposure or a high-illuminance short-time exposure may be employed and in particular, in the latter case, a laser scanning exposure system that the exposure time per one pixel is shorter than about $10^{-4}$ second is preferred.

Also, at the exposure, it is preferred to use the band-stop filter described in U.S. Pat. No. 4,880,726. By using the filter, light color mixing is removed and the color reproducibility is remarkably improved.

Then, the following examples are intended to illustrate the present invention but not to limit the invention in any way.

EXAMPLE 1

After applying a corona discharging treatment to the surface of a paper support both the surfaces of which were laminated with polyethylene, by forming a gelatin undercoat layer containing sodium dodecylbenzenesulfonate on the surface of the support and further by coating thereon various photographic constituting layers, a multilayer color printing paper (101) having the layer structure described below was prepared. The coating liquids were prepared as described below.

Preparation of Coating Liquid for Layer 1:

After dissolving 122.0 g of a yellow coupler (RY-3), 7.5 g of a color image stabilizer (Cpd-2), 16.7 g of a color image stabilizer (Cpd-3), and 8.0 g of a color image stabilizer (Cpd-5) in a mixed solvent composed of 22 g of a solvent (Solv-3), 22 g of a solvent (Solv-9), and 180 ml of ethyl acetate, the solution was dispersed by emulsification in 1000 g of an aqueous 10% gelatin solution containing 86 ml of an aqueous solution of 10% sodium dodecylbenzenesulfonate to provide an emulsified dispersion A. On the other hand, a silver chlorobromide emulsion A [a 3:7 mixture (silver mol ratio) of a large cubic silver halide grain size emulsion A having a mean grain size of 0.88 μm and a small cubic silver halide grain size emulsion A having a mean grain size of 0.70 μm; the variation coefficients of the grain size distributions of the emulsions were 0.08 and 0.10, respectively; and in each emulsion, the silver halide grains locally contained 0.3 mol % silver bromide at a part of the surface of silver chloride grains as the base grains) was prepared. The silver halide emulsion contained the blue-sensitive sensitizing dyes A, B, and C shown below in an amount of $8.0\times10^{-5}$ mol each in the large grain size emulsion A and in an amount of $1.0\times10^{-4}$ mol each in the small grain size emulsion A per mol of silver. Also, the chemical ripening of the emulsion was carried out by adding thereto a sulfur sensitizer and a gold sensitizer.

The emulsified dispersion A was mixed with the silver chlorobromide emulsion and the coating liquid for Layer 1 was prepared such that the composition became as shown below. In addition, the coated amount of each silver halide emulsion described below is the coated amount converted as the amount of silver.

The coating liquids for Layer 2 to layer 7 were prepared according to the same method as the coating liquid for Layer 1. In addition, for each layer, 1-oxy-3,5-dichloro-s-triazine sodium salt was used as a gelatin hardener.

To each layer were added Cpd-12, Cpd-13, Cpd -14, and Cpd-15 such that the total amounts thereof became 15.0 mg/m², 60.0 mg/m², 5.0 mg/m², and 10 mg/m², respectively.

For the silver chlorobromide emulsion of each light-sensitive silver halide emulsion layer, the following spectral sensitizing dye was used.

Blue-Sensitive Emulsion Layer:

Sensitizing Dye A

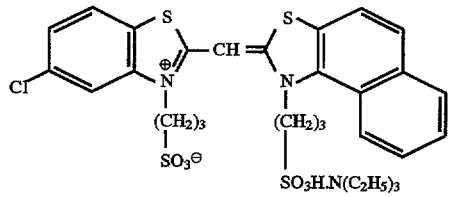

Sensitizing Dye B

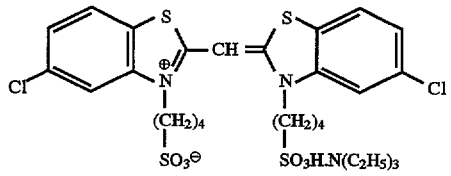

Sensitizing Dye C

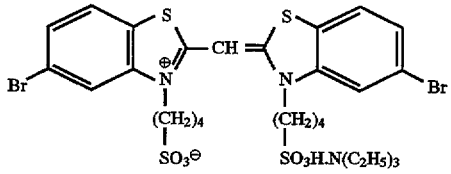

(Each sensitizing dye was added to the large grain size emulsion in an amount of $1.4\times10^{-4}$ mol and to the small grain size emulsion in an amount of $1.7\times10^{-4}$ mol per mol of the silver halide.)

Green-Sensitive Emulsion Layer:

Sensitizing Dye D

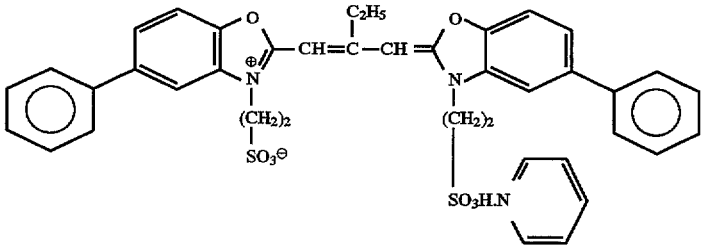

-continued

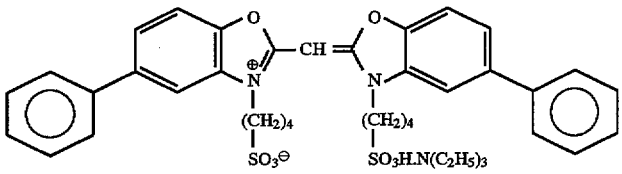

Sensitizing Dye E

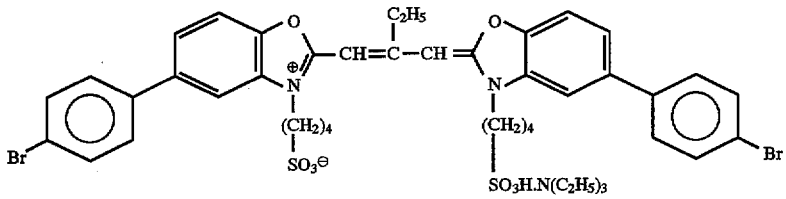

Sensitizing Dye F (The sensitizing dye D was added to the large grain size emulsion in an amount of $3.0\times10^{-4}$ and to the small grain size emulsion in an amount of $3.6\times10^{31\ 4}$ mol per mol of the silver halide, the sensitizing dye E to the large grain size emulsion in an amount of $4.0\times10^{-4}$ mol and to the small grain size emulsion in an amount of $7.0\times10^{-5}$ mol per mol of the silver halide, and the sensitizing dye F to the large grain size emulsion in an amount of $2.0\times10^{-4}$ mol and to the small grain size emulsion in an amount of $2.8\times10^{-4}$ mol per mol of the silver halide.)

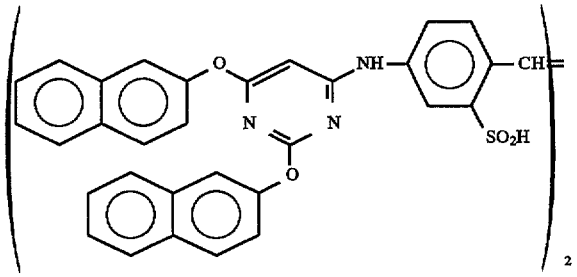

2

Red-Sensitive Emulsion Layer:

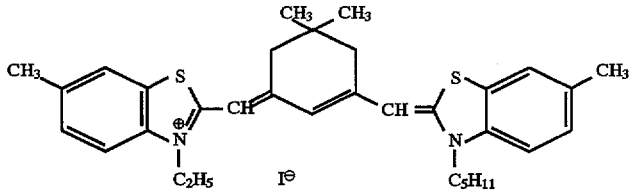

Sensitizing Dye G

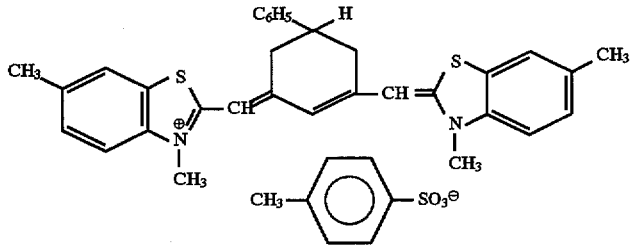

Sensitizing Dye H (Each sensitizing dye was added to the large grain size emulsion in an amount of $5.0\times10^{-5}$ mol and to the small grain size emulsion in an amount of $8.0\times10^{-5}$ mol per mol of the silver halide.) Furthermore, the compound shown below was added to the red-sensitive emulsion in an amount of $2.6\times10^{-3}$ mol per mol of the silver halide.

Also, to the blue-sensitive emulsion layer, the green-sensitive emulsion layer, and the red-sensitive emulsion layer was added 1-(5-methylureidophenyl)-5-mercaptotetrazole in the amounts of $3.3\times10^{-4}$ mol, $1.0\times10^{-3}$ mol, and $5.9\times10^{-4}$ mol, respectively, per mol of the silver halide.

Furthermore, the foregoing compound was added to Layer 2, Layer 4, Layer 6, and Layer 7 in an amount of 0.2 mg/m$^2$, 0.2 mg/m$^2$, 0.6 mg/m$^2$, and 0.1 mg/m$^2$, respectively.

Also, to the blue-sensitive emulsion layer and the green-sensitive emulsion layer was added 4-hydroxy-6-methyl-1,3,3a,7-tetrazaindene in an amount of $1\times10^{-4}$ mol and $2\times10^{-4}$ mol, respectively, per mol of the silver halide.

Also, in order to prevent irradiation, the following dyes were added (the numerals in the parenthesis represented the coated amount) to each silver halide emulsion layer.

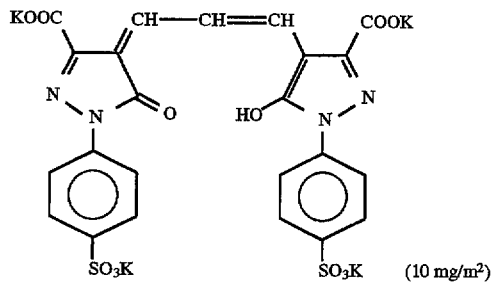

(10 mg/m²)

and

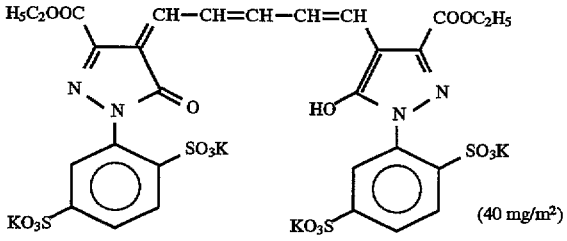

(40 mg/m²)

(Layer Constitution)

The layer constitution of each layer is shown below, wherein the numerals represent the coated amount (g/m²) and the amount of the silver halide emulsion is represented by the coated amount converted as the amount of silver.

Support:

Polyethylene-Laminated Paper:

[The polyethylene layer on the Layer 1 side contained a white pigment (15% by weight; $TiO_2$) and a bluish pigment (ultramarine blue).]

| | |
|---|---|
| Layer 1: Blue-Sensitive Emulsion Layer | |
| Silver Chlorobromide Emulsion A | 0.27 |
| Gelatin | 1.60 |
| Yellow Coupler (RY-3) | 0.61 |
| Color Image Stabilizer (Cpd-2) | 0.04 |
| Color Image Stabilizer (Cpd-3) | 0.08 |
| Color Image Stabilizer (Cpd-5) | 0.04 |
| Solvent (Solv-3) | 0.11 |
| Solvent (Solv-9) | 0.11 |
| Layer 2: Color Mixing Inhibition Layer | |
| Gelatin | 0.99 |
| Color Mixing Inhibitor (Cpd-4) | 0.10 |
| Solvent (Solv-1) | 0.07 |
| Solvent (Solv-2) | 0.20 |
| Solvent (Solv-3) | 0.15 |
| Solvent (Solv-7) | 0.12 |
| Layer 3: Green-Sensitive Emulsion Layer | |
| Silver Chlorobromide Emulsion [Cubic, 1:3 mixture of large grain size emulsion B having mean grain size of 0.55 μm and small grain size emulsion B having mean grain size of 0.39 μm, variation coeffs. of the grain size distributions: 0.10 and 0.08, respectively, each emulsion locally had 0.8 mol % silver bromide at a part of the surface of silver halide grains as the base grains] | 0.13 |
| Gelatin | 1.35 |
| Magenta Coupler (ExM-1) | 0.12 |
| Ultraviolet Absorber (UV-1) | 0.12 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.08 |
| Color Image Stabilizer (Cpd-8) | 0.01 |
| Solvent (Solv-4) | 0.30 |
| Solvent (Solv-5) | 0.15 |
| Layer 4: Color Mixing Inhibition Layer | |
| Gelatin | 0.72 |
| Color Mixing Inhibitor (Cpd-4) | 0.07 |
| Solvent (Solv-1) | 0.05 |
| Solvent (Solv-2) | 0.15 |
| Solvent (Solv-3) | 0.12 |
| Solvent (Solv-7) | 0.09 |
| Layer 5: Red-Sensitive Emulsion Layer | |
| Silver Chlorobromide Emulsion [Cubic, 1:4 mixture of large grain size emulsion C having mean grain size of 0.50 μm and small grain size emulsion C having mean grain size of 0.41 μm, variation coeffs. of the grain size distributions: 0.09 and 0.11, respectively, each emulsion locally had 0.8 mol % silver bromide at a part of the surface of silver halide grains as the base grains) | 0.18 |
| Gelatin | 0.80 |
| Cyan Coupler (ExC-1) | 0.28 |
| Ultraviolet Absorber (UV-3) | 0.19 |
| Color Image Stabilizer (Cpd-1) | 0.24 |
| Color Image Stabilizer (Cpd-6) | 0.01 |
| Color Image Stabilizer (Cpd-8) | 0.01 |
| Color Image stabilizer (Cpd-9) | 0.04 |
| Color Image Stabilizer (Cpd-10) | 0.01 |
| Solvent (Solv-1) | 0.01 |
| Solvent (Solv-6) | 0.21 |
| Layer 6: Ultraviolet Absorption Layer | |
| Gelatin | 0.64 |
| Ultraviolet Absorber (UV-2) | 0.39 |
| Color Image Stabilizer (Cpd-7) | 0.05 |
| Solvent (Solv-8) | 0.05 |
| Layer 7: Protective Layer | |
| Gelatin | 1.01 |
| Acryl-Modified Copolymer (modified degree 17%) of Polyvinyl Alcohol | 0.04 |
| Fluid Paraffin | 0.02 |
| Surfactant (Cpd-11) | 0.01 |

The compounds used above are shown below.

(ExM-1) Magenta Coupler
A 1:1 mixture (by weight) of
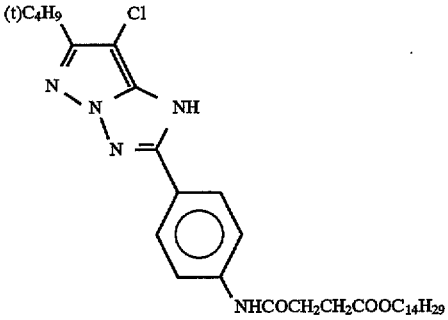
and
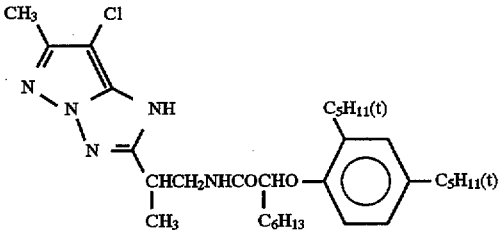
(ExC-1) Cyan coupler
A 15:85 mixture (by mol) of
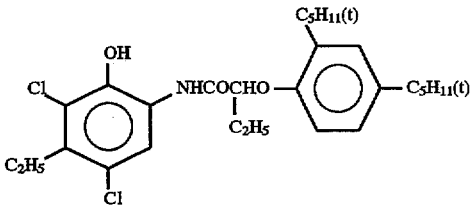
and
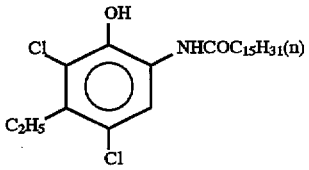
(Cpd-1) Color image stabilizer
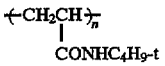
average molecular weight: 60,000
(Cpd-2) Color image stabilizer
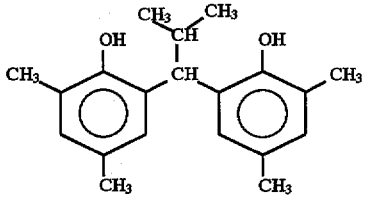

-continued
(Cpd-3) Color Image Stabilizer
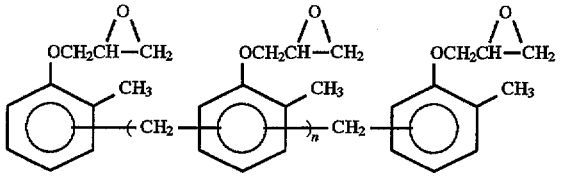
n = 7~8 (average)
(Cpd-4) Color mixing inhibitor
A 1:1:1 mixutre (by weight) of
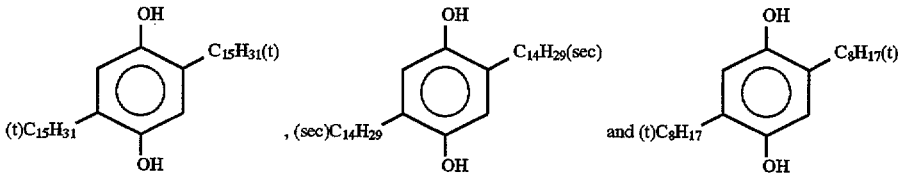
(Cpd-5) Color image stabilizer
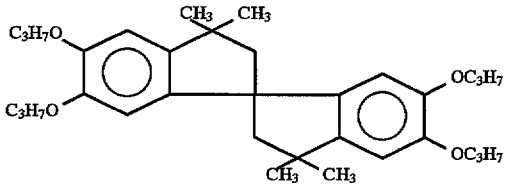
(Cpd-6) Color image stabilizer
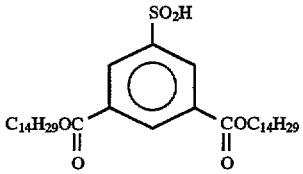
(Cpd-7) Color image stabilizer
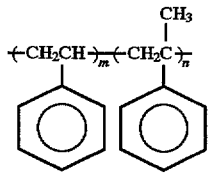
number average molecular weight: 600
m/n = 10/90
(Cpd-8) Color image stabilizer
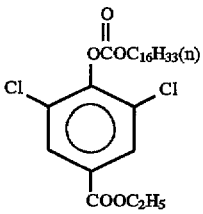
(Cpd-9) Color image stablizer
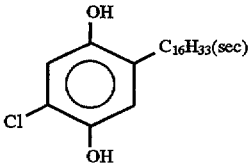

-continued
(Cpd-10) Color image stabilizer
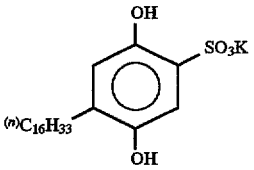
(Cpd-11) Surfactant
A 7:3 mixture (by weight) of
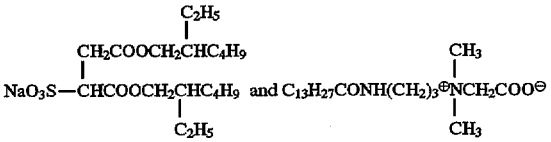
(Cpd-12) Antiseptic
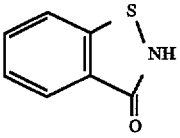
(Cpd-13) Antiseptic
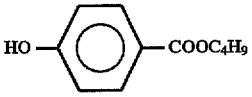
(Cpd-14) Antiseptic
A 1:1:1:1 mixture (by weight) of a, b, c and d
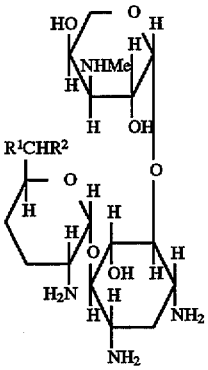
| | $R^1$ | $R^2$ |
|---|---|---|
| a | —Me | —NHMe |
| b | —Me | —$NH_2$ |
| c | —H | —$NH_2$ |
| d | —H | —NHMe |
(Cpd-15) Antiseptic
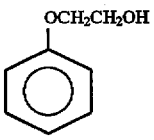

-continued
(UV-1) Ultraviolet absorber
A 1:3:4 mixture (by weight) of (1), (2) and (3)
(1)
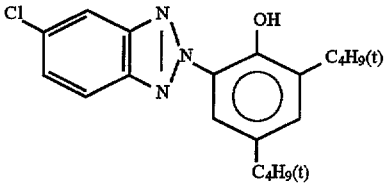
(2)
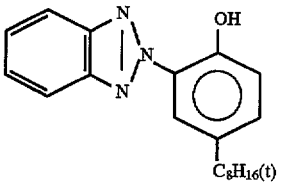
(3)
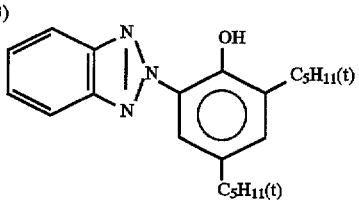
(UV-2) Ultraviolet absorber
A 1:2:2:3:1 mixture (by weight) of (1), (2), (3), (4) and (5)
(1)
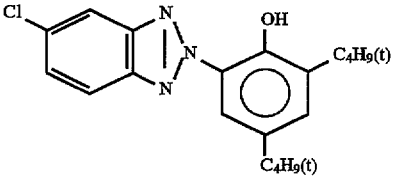
(2)
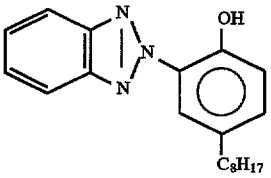
(3)
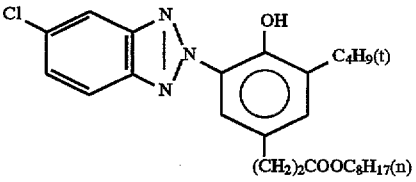
(4)
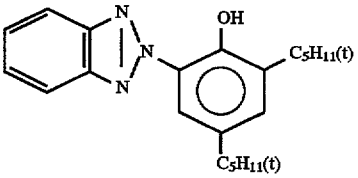
(5)
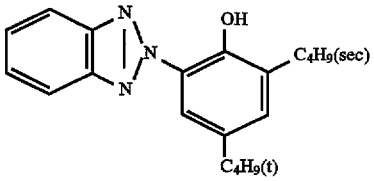
(UV-3) Ultraviolet absorber
A 1:3:2:1 mixture (by weight) of (1), (2), (3) and (4)
(1)
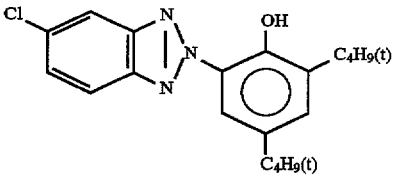
(2)
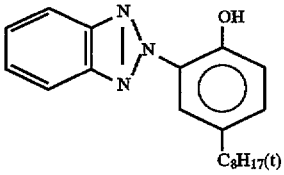

-continued
(3)
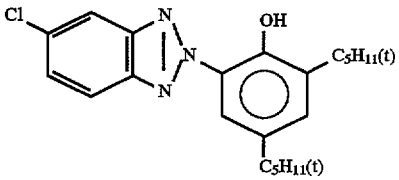
(4)
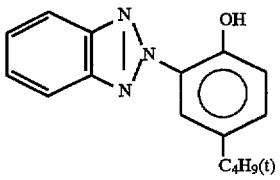
(Solv-1) Solvent
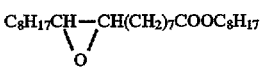
(Solv-2) Solvent
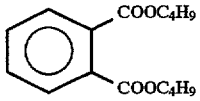
(Solv-3) Solvent
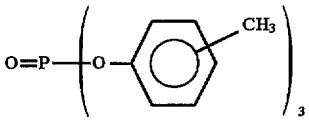
(Solv-4) Solvent
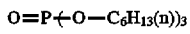
(Solv-5) Solvent
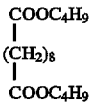
(Solv-6) Solvent
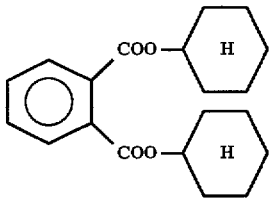
(Solv-7) Solvent
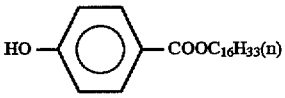
(Solv-8) Solvent
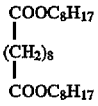
(Solv-9) Solvent
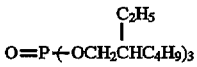
RY-1
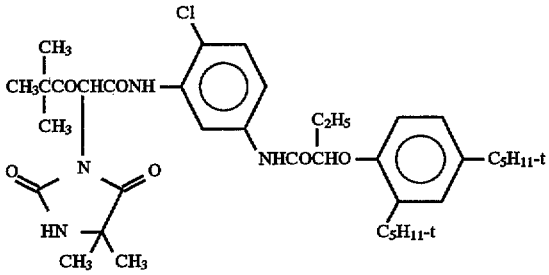

-continued
RY-2
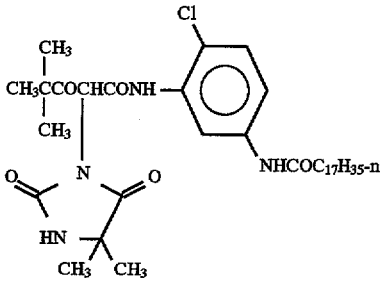
RY-3
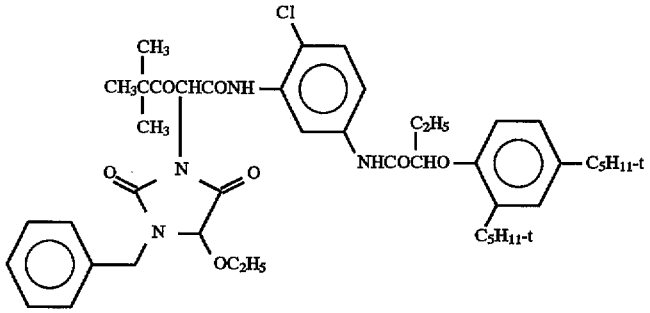
RY-4
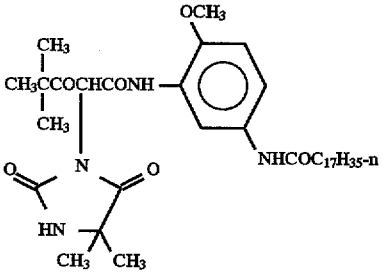
RY-5
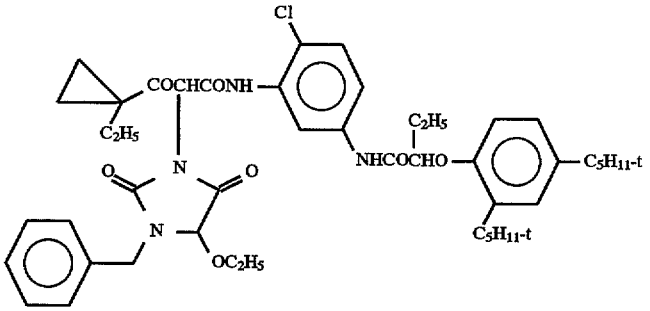
RY-6
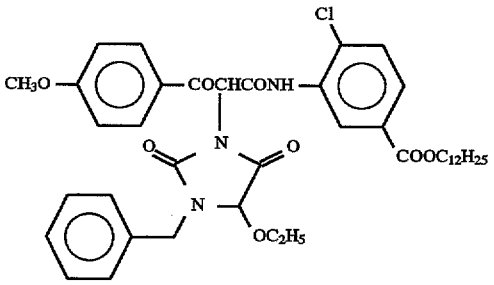

-continued
RY-7
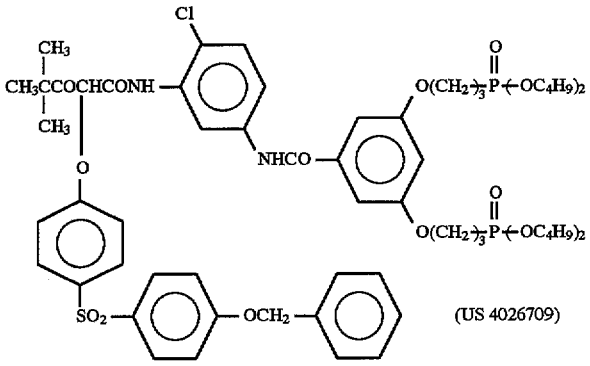
(US 4026709)
RY-8
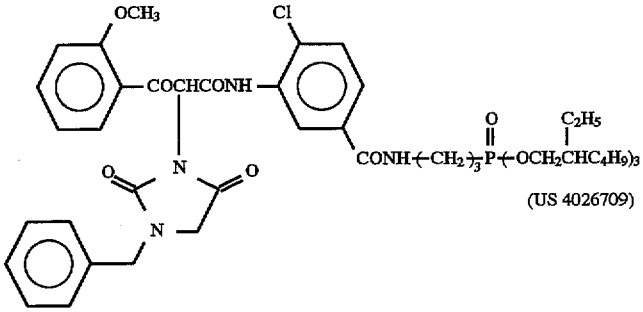
(US 4026709)
RY-9
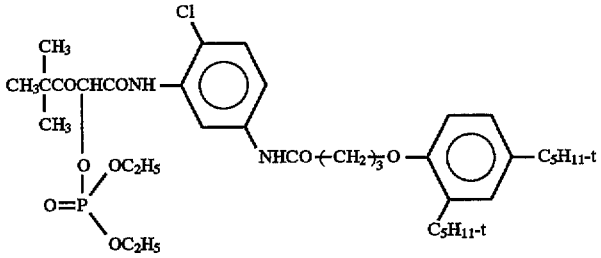
(JP-A-52-20023)
RY-10
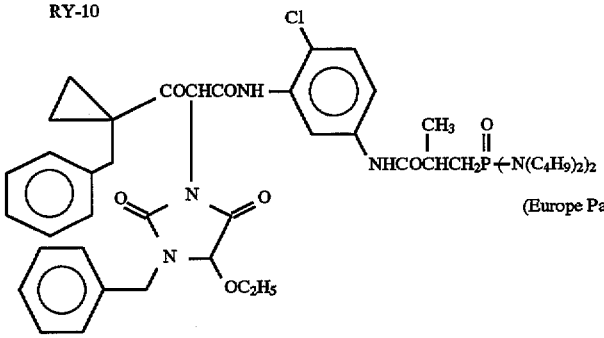
(Europe Patent 570006A)

-continued

RY-11

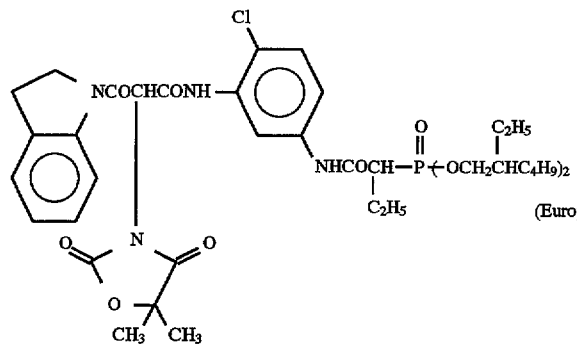

(Europe Patent 570006A)

Thus, Sample 101 was prepared.

Also, Samples 102 to 133 were prepared by in the same procedure as the case of preparing Sample 101 except that the yellow coupler (RY-3) was replaced with each of the yellow couplers as shown in Table A below. In these cases, the yellow coupler was replaced such that the amount of each coupler became the equimolar amount.

Furthermore, Samples 201 to 233 were prepared by using the emulsions used for Samples 101 to 133, respectively, which had been stored for 30 hours at 5° C.

Each sample thus prepared was exposed using a sensitometer (manufactured by Fuji Photo Film Co., Ltd.; the color temperature of the FWH type light source was 3200K) such that about 35% of the coated silver amount was developed to give gray.

Each sample (50 $m^2$ each) thus exposed was continuously processed by the following processing steps.

| Processing Step | Temperature | Time | Replenished Amount* |
|---|---|---|---|
| Color Development | 38.5° C. | 45 sec. | 73 ml |
| Bleach-Fix | 35° C. | 45 sec. | 60 ml** |
| Rinse (1) | 35° C. | 30 sec. | — |
| Rinse (2) | 35° C. | 30 sec. | — |
| Rinse (3) | 35° C. | 30 sec. | 360 ml |
| Drying | 80° C. | 60 sec. | |

*The replenishing amount per square meter of the photographic material.
**In addition to 60 ml described above, 120 ml per square meter of the light-sensitive material was supplied from Rinse (1).

The replenishing amount per square meter of the photographic material.

In addition to 60 ml described above, 120 ml per square meter of the light-sensitive material was supplied from Rinse (1).

[The rinse was a 3-tanks counter current system of from (3) to (1).]

The composition of each processing liquid was as follows.

| | Tank Liquid | Replenisher |
|---|---|---|
| Color Developer: | | |
| Water | 800 ml | 800 ml |
| Ethylenediaminetetraacetic Acid | 3.0 g | 3.0 g |
| 4,5-Dihydroxybenzene-1,3-disulfonic Acid 2-Sodium Salt | 0.5 g | 0.5 g |

-continued

| | Tank Liquid | Replenisher |
|---|---|---|
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Whitening Agent (Whitex 4, made by Sumitomo Chemical Company Limited) | 1.0 g | 3.0 g |
| Sodium Sulfite | 0.1 g | 0.1 g |
| Disodium-N,N-bis(sulfonate ethyl)-Hydroxylamine | 5.0 g | 10.0 g |
| Sodium Triisopropylnaphthalene(β)-sulfonate | 0.1 g | 0.1 g |
| N-Ethyl-N-(β-methanesulfonamido-ethyl)-3-methyl-4-aminoaniline.-3/2 Sulfuric Acid.1-hydrate | 5.0 g | 11.5 g |
| Water to make | 1 liter | 1 liter |
| pH (adjusted with 25° C./potassium hydroxide and sulfuric acid) | 10.00 | 11.00 |
| Bleach-Fix Liquid: | | |
| Water | 600 ml | 150 ml |
| Ammonium Thiosulfate (750 g/liter) | 93 ml | 230 ml |
| Ammonium Sulfite | 40 g | 100 g |
| Ethylenediaminetetraacetic Acid Iron(III) Ammonium | 55 g | 135 g |
| Ethylenediaminetetraacetic Acid | 5 g | 12.5 g |
| Nitric Acid (67%) | 30 g | 65 g |
| Water to make | 1 liter | 1 liter |
| pH (adjusted with 25° C./acetic acid and aqueous ammonia) | 5.8 | 5.6 |
| Rinse Liquid: [tank liquid = replenisher) | | |
| Chlorinated Sodium Isocyanurate | | 0.02 g |
| Deionized Water (electrical conductivity: | | |
| not greater than 5 μs/cm) | | 1 liter |
| pH | | 6.5 |

Then, each sample was subjected to a gradation exposure with blue light and processed with the foregoing running processing liquids. The color density of each sample after processing was measured with blue light and the yellow maximum color density Dmax was determined.

Furthermore, each of Samples 101 to 133 was exposed under a light source of a fluorescent lamp of 80,000 lux for 14 days and the color image residual ratio in the initial density of 1.5 was determined. Also, each sample was stored for 20 days under 80° C.–70% RH and the color image residual ratio in the initial density 1.5 was determined.

These results are shown in Table A below.

TABLE A

| Sample | Yellow Coupler | Coloring Property Dmax | Xe | 80° C. - 70% | Sample | Dmax | Remarks |
|---|---|---|---|---|---|---|---|
| 101 | RY-3 | 2.02 | 70 | 74 | 201 | 1.92 | Comparison |
| 102 | RY-1 | 2.03 | 64 | 72 | 202 | 1.91 | " |
| 103 | RY-2 | 2.10 | 60 | 67 | 203 | 1.78 | " |
| 104 | RY-4 | 2.07 | 58 | 63 | 204 | 1.74 | " |
| 105 | Y-1 | 2.26 | 83 | 82 | 205 | 2.24 | Invention |
| 106 | Y-2 | 2.25 | 86 | 83 | 206 | 2.24 | " |
| 107 | Y-3 | 2.23 | 86 | 83 | 207 | 2.21 | " |
| 108 | Y-5 | 2.21 | 81 | 80 | 208 | 2.19 | " |
| 109 | Y-7 | 2.22 | 81 | 81 | 209 | 2.19 | " |
| 110 | Y-9 | 2.18 | 78 | 80 | 210 | 2.14 | " |
| 111 | Y-10 | 2.20 | 79 | 81 | 211 | 2.18 | " |
| 112 | Y-11 | 2.17 | 77 | 80 | 212 | 2.15 | " |
| 113 | Y-13 | 2.16 | 76 | 79 | 213 | 2.15 | " |
| 114 | Y-17 | 2.24 | 81 | 81 | 214 | 2.22 | " |
| 115 | Y-19 | 2.17 | 85 | 85 | 215 | 2.17 | " |
| 116 | Y-20 | 2.24 | 83 | 82 | 216 | 2.21 | " |
| 117 | Y-21 | 2.18 | 87 | 86 | 217 | 2.18 | " |
| 118 | Y-22 | 2.16 | 82 | 80 | 218 | 2.14 | " |
| 119 | RY-5 | 2.16 | 51 | 74 | 219 | 2.04 | Comparison |
| 120 | Y-32 | 2.26 | 79 | 88 | 220 | 2.25 | Invention |
| 121 | Y-29 | 2.27 | 77 | 86 | 221 | 2.25 | " |
| 122 | RY-10 | 2.20 | 42 | 75 | 222 | 2.10 | Comparison |
| 123 | Y-45 | 2.32 | 77 | 88 | 223 | 2.30 | Invention |
| 124 | Y-30 | 2.33 | 76 | 87 | 224 | 2.31 | " |
| 125 | RY-6 | 1.95 | 48 | 58 | 225 | 2.03 | Comparison |
| 126 | Y-15 | 2.08 | 74 | 78 | 226 | 2.28 | Invention |
| 127 | RY-7 | 2.05 | 57 | 64 | 227 | 1.95 | Comparison |
| 128 | Y-14 | 2.20 | 79 | 80 | 228 | 2.17 | Invention |
| 129 | RY-8 | 1.98 | 61 | 69 | 229 | 1.84 | Comparison |
| 130 | Y-44 | 2.11 | 75 | 81 | 230 | 2.10 | Invention |
| 131 | RY-11 | 2.16 | 70 | 75 | 231 | 2.04 | Comparison |
| 132 | Y-46 | 2.27 | 81 | 89 | 232 | 2.24 | Invention |
| 133 | RY-9 | 2.05 | 64 | 61 | 233 | 1.87 | Comparison |

*: After 30 days at 5° C.

Samples using RY-couplers as the yellow couplers are comparative samples and samples using Y-couplers are samples of this invention.

As is clear from Table A above, it can be seen that the yellow couplers of this invention show a high coloring property as compared with known yellow couplers RY-1 to RY-11.

Furthermore, since known yellow couplers are inferior in solubility, the coloring property (Dmax) after cold storing the emulsions for 30 days at 5° C. is greatly inferior, while in the case of using the yellow couplers of this invention, lowering of the coloring property is scarcely observed, which shows the excellency of the yellow couplers of this invention. Also, as is clear from Table A, the yellow couplers of this invention are excellent in the fastness to heat, humidity, and light as compared with the known yellow couplers.

Furthermore, it can be seen that the improvement of the properties is particularly remarkable in the yellow couplers represented by formula (II) described above.

EXAMPLE 2

Samples 301 to 343 were prepared in the same procedure as the case of preparing Sample 102 in Example 1 except that the yellow coupler in Layer 1 of Sample 102 was changed as shown in Table B shown below and the amide compound represented by formula (IV) being used in this invention was added as described in Table B. The yellow coupler was added such that the addition amount was equimolar amount to that in Sample 102.

Then, each sample was subjected to a gradation exposure with blue light and processed with the running processing liquids described in Example 1. The color density of each sample after processing was measured with blue light and the yellow maximum color density Dmax was determined.

Furthermore, each of Samples 301 and 343 was exposed under the light source of a fluorescent lamp of 80,000 lux for 14 days and the color image residual ratio in the initial density 1.5 was determined. Also, each sample was stored under 80° C.–70% RH for 20 days and the color image residual ratio to the initial density 1.5 was determined.

The results are shown in Table B below.

TABLE B

| Sample | Yellow Coupler | Amide Compound (0.2 g/m$^2$) | Coloring Property Dmax | Xe | 80° C. - 70% | Remarks |
|---|---|---|---|---|---|---|
| 301 | RY-1 | — | 2.03 | 64 | 72 | Comparison |
| 302 | " | S-1 | 2.05 | 71 | 73 | " |
| 303 | RY-2 | — | 2.10 | 60 | 67 | " |
| 304 | " | S-1 | 2.12 | 69 | 68 | " |
| 305 | Y-1 | — | 2.26 | 83 | 82 | Invention |
| 306 | " | S-1 | 2.37 | 94 | 90 | " |
| 307 | Y-2 | — | 2.25 | 86 | 83 | " |
| 308 | " | S-1 | 2.30 | 95 | 91 | " |
| 309 | Y-3 | — | 2.23 | 86 | 83 | " |
| 310 | " | S-1 | 2.29 | 95 | 91 | " |
| 311 | Y-7 | — | 2.22 | 81 | 81 | " |
| 312 | " | S-1 | 2.28 | 91 | 88 | " |
| 313 | Y-9 | — | 2.18 | 78 | 80 | " |
| 314 | " | S-1 | 2.25 | 88 | 87 | " |
| 315 | Y-17 | — | 2.24 | 81 | 81 | " |
| 316 | " | S-1 | 2.30 | 92 | 89 | " |
| 317 | Y-20 | — | 2.24 | 83 | 82 | " |
| 318 | " | S-1 | 2.29 | 92 | 90 | " |
| 319 | RY-5 | — | 2.16 | 51 | 74 | Comparison |
| 320 | " | S-1 | 2.17 | 60 | 75 | " |
| 321 | Y-29 | — | 2.27 | 77 | 86 | Invention |
| 322 | " | S-1 | 2.31 | 91 | 90 | " |
| 323 | RY-10 | — | 2.20 | 42 | 75 | Comparison |
| 324 | " | S-1 | 2.22 | 51 | 76 | " |
| 325 | Y-45 | — | 2.32 | 77 | 88 | Invention |
| 326 | " | S-1 | 2.37 | 92 | 92 | " |
| 327 | RY-11 | — | 2.16 | 70 | 75 | Comparison |
| 328 | " | S-1 | 2.18 | 74 | 77 | " |
| 329 | Y-46 | — | 2.27 | 81 | 89 | Invention |
| 330 | " | S-1 | 2.33 | 90 | 94 | " |
| 331 | Y-1 | — | 2.26 | 83 | 82 | " |
| 332 | " | S-1 | 2.31 | 94 | 90 | " |
| 333 | " | S-2 | 2.30 | 91 | 88 | " |
| 334 | " | S-4 | 2.30 | 92 | 89 | " |
| 335 | " | S-5 | 2.29 | 90 | 87 | " |
| 336 | " | S-9 | 2.29 | 89 | 86 | " |
| 337 | " | S-18 | 2.29 | 88 | 86 | " |
| 338 | " | S-20 | 2.29 | 88 | 87 | " |
| 339 | " | S-21 | 2.28 | 86 | 85 | " |
| 340 | " | S-23 | 2.28 | 86 | 86 | " |
| 341 | " | S-25 | 2.29 | 87 | 86 | " |
| 342 | " | S-26 | 2.29 | 86 | 87 | " |
| 343 | " | S-27 | 2.29 | 89 | 82 | " |

As is clear from Table B, it can be seen that by using the amide compounds represented by formula (IV) for use in this invention, the coloring property of the yellow couplers represented by formula (I) for use in this invention and the fastness of the dyes formed from the yellow couplers represented by formula (I) to light, heat, and humidity are remarkably improved.

The improvement of the properties are remarkable in the amide compounds represented by formula (V) and are more remarkable in the amide compounds represented by formula (VI).

On the other hand, in the case of using the known yellow couplers, even when the amide compounds represented by formula (IV) are used, the improvement of the properties obtained by using the yellow couplers represented by formula (I) being used in this invention is not obtained.

As described above, the yellow couplers for use in this invention are excellent in the coloring property and the cold storage stability of the silver halide emulsions containing them and the yellow images obtained using the yellow couplers are excellent in the fastness to light, heat, and humidity.

What is claimed is:

1. A silver halide color photographic material comprising a support having provided thereon at least one photographic layer containing at least one yellow dye-forming coupler represented by formula (II)

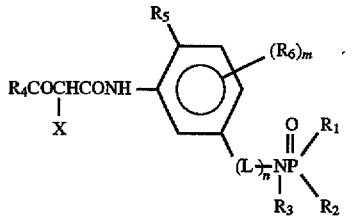

(II)

wherein $R_1$ and $R_2$ each independently represents an aliphatic oxy group, an aliphatic group, an aryloxy group, an aryl group, an aliphatic amino group, or an anilino group; $R_3$ represents a hydrogen atom, an aliphatic group, or an aryl group; and $R_4$ represents an alkyl group, a cycloalkyl group, an aryl group, an alkylamino group, an anilino group, or a heterocyclic group; $R_5$ represents a hydrogen atom, a halogen atom, an aliphatic oxy group, an aryloxy group, an aliphatic group, or an amino group; $R_6$ represents a substituent; L represents a divalent linkage group selected from —N($R_{21}$)CO—A*—, —N($R_{21}$)$SO_2$—A*—, —CON($R_{21}$)—A*—, —$SO_2$N($R_{21}$)—A*— and —COO—A*— wherein A represents a $C_{1-20}$ alkylene group or a $C_{6-20}$ phenylene group; $R_{21}$ represents a hydrogen atom, an aliphatic group, or an aryl group; and the mark * represents a bond to—N($R_3$)P(=O)$R_1$($R_2$); m represents an integer of from 0 to 3; n represents 0 or 1; and X represents a heterocyclic group represented by formula (III-1), (III-2), or (III-3):

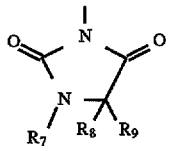

(III-1)

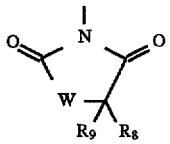

(III-2)

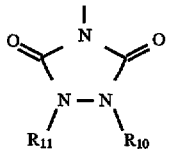

(III-3)

wherein $R_8$ and $R_9$ each independently represents a hydrogen atom, an alkyl group, an aryl group, an alkoxy group, an aryloxy group, or a hydroxyl group; $R_7$, $R_{10}$ and $R_{11}$ each independently represents a hydrogen atom, an alkyl group, an aryl group, an aralkyl group, or an acyl group; and wherein W represents an oxygen atom or a sulfur atom.

2. The silver halide color photographic material of claim 1, wherein n is 0 in the yellow dye-forming coupler represented by formula (II).

3. The silver halide color photographic material of claim 2, wherein, in formula (II), X is a group represented by formula (III-1); $R_5$ is a chlorine atom or a methoxy group; m is 0; n is 0; $R_1$ and $R_2$ are the same, and represent an aliphatic oxy group or an aryloxy group; and $R_3$ is a hydrogen atom:

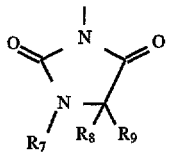

(III-1)

wherein $R_7$ represents a hydrogen atom, an alkyl group, an aryl group, an aralkyl group or an acyl group; $R_8$ and $R_9$ each independently represents a hydrogen atom, an alkyl group, an aryl group, an alkoxy group, an aryloxy group or a hydroxyl group.

4. The silver halide color photographic material of claim 1, wherein $R_4$ in formula (II) is a t-butyl group, a 4-methoxyphenyl group, a 1-ethylcyclopropyl group or a 1-indolinyl group.

5. The silver halide color photographic material of claim 1, wherein X in formula (II) is a group represented by formula (III-1)

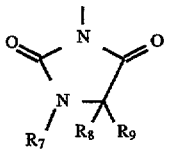

(III-1)

wherein $R_7$, $R_8$ and $R_9$ each independently is a hydrogen atom or a methyl group.

6. The silver halide color photographic material of claim 1, further comprising a compound represented by formula (IV), or an oligomer or polymer comprising a moiety of the compound represented by formula (IV)

$$R_{31}CON(R_{32})R_{33} \quad \text{(IV)}$$

wherein $R_{31}$, $R_{32}$, and $R_{33}$ each independently represents a hydrogen atom, an aliphatic group, or an aryl group, provided that the sum of the carbon atom numbers of $R_{31}$, $R_{32}$, and $R_{33}$ is from 9 to 80, or $R_{31}$ and $R_{32}$, or $R_{32}$ and $R_{33}$ may combine with each other to form a ring.

7. The silver halide color photographic material of claim 1, further comprising a compound represented by formula (V), or an oligomer or polymer comprising a moiety of the compound represented by formula (V)

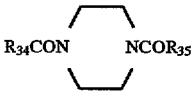

(V)

wherein $R_{34}$ and $R_{35}$ each independently represents a hydrogen atom, an aliphatic group, or an aryl group, wherein the sum of the carbon atom numbers of $R_{34}$ and $R_{35}$ is from 12 to 75.

* * * * *